US008582799B2

(12) United States Patent
Tanabe

(10) Patent No.: US 8,582,799 B2
(45) Date of Patent: Nov. 12, 2013

(54) SPEAKER DEVICE

(75) Inventor: Kei Tanabe, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 172 days.

(21) Appl. No.: 12/958,012

(22) Filed: Dec. 1, 2010

(65) Prior Publication Data

US 2011/0135141 A1 Jun. 9, 2011

(30) Foreign Application Priority Data

Dec. 7, 2009 (JP) ..... 2009-277627

(51) Int. Cl.
*H04R 1/00* (2006.01)

(52) U.S. Cl.
USPC ..... 381/407; 381/386; 381/424; 381/395; 381/396; 381/412

(58) Field of Classification Search
USPC ..... 381/431, 396, 399, 407, 386, 423, 424, 381/421, 422, 395, 398, 412
See application file for complete search history.

(56) References Cited

U.S. PATENT DOCUMENTS 6,421,449 B1 * 7/2002 Hasegawa et al. ..... 381/401
7,376,240 B2 * 5/2008 Hansen et al. ..... 381/421
8,259,987 B2 * 9/2012 Omoda ..... 381/423
2005/0276435 A1 * 12/2005 Watanabe ..... 381/399
2011/0123061 A1 5/2011 Kamimura et al.

FOREIGN PATENT DOCUMENTS

| | | |
|---|---|---|
| JP | 59-104899 | 6/1984 |
| JP | 2003-032786 | 1/2003 |
| JP | 2009-278523 | 11/2009 |
| WO | WO2009/139202 | 11/2009 |

OTHER PUBLICATIONS

Office Action with English translation for Japanese Patent Application No. 2009-277627 sent Jul. 3, 2013, 4 pgs.

* cited by examiner

*Primary Examiner* — Davetta W Goins
*Assistant Examiner* — Amir Etesam
(74) *Attorney, Agent, or Firm* — Brinks Gilson & Lione

(57) ABSTRACT

A speaker device has a magnet, outer yokes, and inner yokes which are assembled so that a magnetic gap is formed between the outer yoke and inner yokes over which a magnetic flux which is generated from the magnet cuts across. A voice coil unit which is linked to a diaphragm is disposed within the magnetic gap, and positioning members determine the positions of the inner yokes and the outer yokes which attach magnetically to the magnet such that a magnetic gap is formed. The speaker device has a magnetic circuit of which the construction facilitates assembly, and recycling of various individual parts is relatively easy.

22 Claims, 34 Drawing Sheets

SPEAKER DEVICE

RELATED APPLICATION

The present application claims priority to Japanese Patent Application Number 2009-277627, filed Dec. 7, 2009, the entirety of which is hereby incorporated by reference.

BACKGROUND OF THE INVENTION

1. Field of the Invention

The present invention relates to a speaker device that outputs sound by causing vibration of a diaphragm which is connected to a voice coil by mutual action between a magnetic field generated in a magnetic circuit and an audio signal current that flows through the voice coil.

2. Description of the Related Art

Heretofore, a speaker device having an angular and long, thin configuration has been proposed (see Japanese Unexamined Patent Application Publication No. 2003-32786). This speaker device has a configuration wherein a frame having a rectangular flat-face shape contains a magnetic circuit having a pair of rectangular magnets arrayed so as to sandwich a pole piece on a rectangular-shaped yoke having a horizontally elongated pole piece in the center portion thereof and a frame-shaped plate that is fixed on the magnets thereof, and a rectangular-shaped voice coil that is positioned within a magnetic gap which is formed between the pole piece and an inner edge of a frame-shaped plate and is connected to a diaphragm.

With such a speaker device, the voice coil vibrates from mutual action between a magnetic flux that is generated from the magnets in the magnetic circuit and that passes across the magnetic gap through the yoke, pole piece, and plate (functioning as the yoke), and the audio signal current that flows through the voice coil that is positioned within the magnetic gap. The diaphragm connected to this voice coil vibrates, whereby audio is produced according to the audio signal current.

The parts comprising the magnetic circuit such as the above-described yoke, pole piece, magnets, and frame-shaped plate generally maintain a relative position relation so as to form the magnetic gap, while being firmly attached with an adhesive agent (Japanese Unexamined Patent Application Publication No. 59-104899).

Now, it is preferable for the magnetic gap to be narrow, from the perspective of lowering magnetic resistance and more effectively vibrating the voice coil. However, workability is poor for adhering the parts that make up the magnetic circuit with an adhesive agent while accurately maintaining the relative positional relation so that the narrow magnetic gap is formed.

Also, the parts that make up the magnetic circuit are firmly adhered with an adhesive agent, so disassembling the magnetic circuit and individually recycling the various parts is difficult.

The present invention takes this situation into account, and provides a speaker device having a configuration whereby the magnetic circuit can be assembled with good workability, while individually recycling the various parts is relatively easy.

SUMMARY

A speaker device according to a first embodiment of the present invention has a configuration including: a magnet; an outer yoke; an inner yoke integrally forming a magnetic circuit with the magnet and the outer yoke so as to form a magnetic gap between the outer yoke and the inner yoke, such that a magnetic flux generated from the magnet cuts across the gap; a diaphragm; a voice coil unit linked to the diaphragm, disposed within the magnetic gap; and positioning members to determine the positions of the inner yoke and the outer yoke, which link magnetically to the magnet, such that the magnetic gap is formed.

With such a configuration, the outer yoke, and the inner yoke are assembled in the state that the positions of the magnet, the outer yoke, and the inner yoke are determined by the positioning members so as to form the magnetic gap.

The speaker device may have a configuration wherein the positioning member has an inner yoke positioning unit to determine the position of the inner yoke; and a spacer unit to hold the spacing between the inner yoke subjected to positioning by the inner yoke positioning unit and the outer yoke in a spacing of the magnetic gap. With such a configuration, a magnetic gap with spacing that is determined by the spacer unit between the inner yoke and the outer yoke, for which the position is determined by the inner yoke positioning unit of the positioning member, can be easily formed.

The speaker device may have a configuration wherein the voice coil unit further has a voice coil portion formed on the surface of a flexible material in a voice coil array pattern; and a supporting unit that is formed following the voice coil portion of the flexible material, and elastically supports the voice coil portion; wherein the supporting unit is fixed to the positioning member so that the voice coil portion of the flexible material is disposed within the magnetic gap. With such a configuration, the voice coil portion that is elastically supported by the supporting unit fixed to the positioning member is disposed within the magnetic gap that is formed between the inner yoke and the outer yoke subjected to positioning by the positioning members, whereby a speaker device is provided having a configuration wherein the inner yoke and the outer yoke linked magnetically to the magnet and the voice coil unit are integrated with the positioning members.

The speaker device may have a configuration having a frame member that contains the positioning member, the inner yoke and the outer yoke that are subjected to positioning with the positioning member, and the voice coil unit to which a supporting unit that elastically supports the voice coil portion on the positioning member is fixed. With such a configuration, the inner yoke, the outer yoke and the voice coil unit that are magnetically linked to the magnet are contained in the frame member in a state of being integrated with the positioning members.

A speaker device according to a second embodiment of the present invention has a configuration including: a magnet; an outer yoke; an inner yoke integrally forming a magnetic circuit with the magnet and the outer yoke so as to form a magnetic gap between the outer yoke and the inner yoke, such that a magnetic flux generated from the magnet cuts across the gap; a diaphragm; a voice coil unit linked to the diaphragm, disposed within the magnetic gap; a rectangular plate-shaped first outer yoke and second outer yoke; a rectangular plate-shaped first inner yoke and second inner yoke; and positioning members to determine the positions of the first inner yoke and the second inner yoke that sandwich the magnet, and the first outer yoke and the second outer yoke, such that a magnetic gap is formed between a plate face of the first outer yoke and one side end face of each of the first inner yoke and the second inner yoke, and between a plate face of the second outer yoke and the other side end face of each of the first inner yoke and the second inner yoke.

With such a configuration, the first inner yoke and the second inner yoke, and the first outer yoke and the second outer yoke are assembled in a state wherein the first inner yoke and the second inner yoke and the first outer yoke and the second outer yoke which sandwich the magnet are subjected to positioning so that the magnetic gap is formed.

The speaker device may have a configuration wherein the positioning members have an inner yoke positioning portion to determine the positions of the first inner yoke and the second inner yoke in a state of sandwiching the magnet; a first spacer unit to hold the spacing between the first outer yoke and each of the first inner yoke and the second inner yoke subjected to positioning by the inner yoke positioning unit to be the spacing of the magnetic gap; and a second spacer unit to hold the spacing between the second outer yoke and each of the first inner yoke and the second inner yoke subjected to positioning by the inner yoke positioning unit to be the spacing of the magnetic gap.

With such a configuration, a magnetic gap can be easily formed with a spacing that is determined by a first spacer unit between each of the first inner yoke and the second inner yoke subjected to positioning by the inner yoke positioning unit of the positioning member and the first outer yoke, and a magnetic gap with a spacing that is determined by a second spacer unit between each of the first inner yoke and the second inner yoke and a second outer yoke.

The speaker device may have a configuration wherein the voice coil unit has a first voice coil portion formed on the surface of a flexible material in a first voice coil array pattern; a second voice coil portion formed on the surface of a flexible material in a second voice coil array pattern; a first supporting unit that is formed following the first voice coil portion on the flexible material and that elastically supports the first voice coil portion; a second supporting unit that is formed following the second voice coil portion on the flexible material and that elastically supports the second voice coil portion; wherein the first supporting unit is fixed to the positioning member so that the first voice coil portion is disposed in the magnetic gap formed between the first outer yoke and each of the first inner yoke and the second inner yoke; and wherein the second supporting unit is fixed to the positioning member so that the second voice coil portion is disposed in the magnetic gap formed between the second outer yoke and each of the first inner yoke and the second inner yoke.

With such a configuration, the first voice coil portion that is elastically supported by the first supporting unit fixed to the positioning member is disposed in the magnetic gap formed between each of the first inner yoke and the second inner yoke subjected to positioning by the positioning member and the first outer yoke, and the second voice coil portion that is elastically supported by the second supporting unit fixed to the positioning member is disposed in the magnetic gap formed between each of the first inner yoke and the second inner yoke subjected to positioning by the positioning member and the second outer yoke, whereby a speaker device can be realized with a configuration wherein the first inner yoke and the second inner yoke having sandwiched the magnet, the first outer yoke and the second outer yoke, and the voice coil unit having a first voice coil portion and a second voice coil portion, are integrated by positioning members.

The speaker device may have a configuration further including a first positioning member serving as the positioning member to determine the position of one end portion of each of the first inner yoke and the second inner yoke having sandwiched the magnet, and one end portion of each of the first outer yoke and the second outer yoke; and a second positioning member to determine the position of the other end portion of the first inner yoke and the second inner yoke, and the other end portion of the first outer yoke and the second outer yoke.

With such a configuration, the first positioning member and second positioning member determine the positions of the first inner yoke and second inner yoke, and the first outer yoke and the second outer yoke with both end portions thereof, so that a magnetic gap is formed between each of the first inner yoke and the second inner yoke and the first outer yoke, and between each of the first inner yoke and the second inner yoke and the second outer yoke.

The speaker device may have a configuration wherein the voice coil unit has a first voice coil portion formed on the surface of a flexible material in a first voice coil array pattern; a second voice coil portion formed on the surface of a flexible material in a second voice coil array pattern; a first-first supporting unit and a second-first supporting unit that are formed following both end portions of the first voice coil portion on the flexible material and that elastically supports the first voice coil portion; a first-second supporting unit and a second-second supporting unit that are formed following both end portions of the second voice coil portion on the flexible material and that elastically supports the second voice coil portion; wherein the first-first supporting unit and the second-first supporting unit are fixed to the first positioning member and the second positioning member so that the first voice coil portion is disposed in the magnetic gap formed between the first outer yoke and each of the first inner yoke and the second inner yoke; and wherein the first-second supporting unit and the second-second supporting unit are fixed to the first positioning member and the second positioning member so that the second voice coil portion is disposed in the magnetic gap formed between the second outer yoke and each of the first inner yoke and the second inner yoke.

With such a configuration, the first voice coil portion of which both end portions are elastically supported by the first-first supporting unit and the second-first supporting unit fixed to the first positioning member and the second positioning member is disposed in the magnetic gap formed between each of the first inner yoke and the second inner yoke subjected to positioning by the first positioning member and the second positioning member and the first outer yoke, and the second voice coil portion of which both end portions are elastically supported by the first-second supporting unit and the second-second supporting unit fixed to the first positioning member and the second positioning member is disposed in the magnetic gap formed between each of the first inner yoke and the second inner yoke subjected to positioning by the first positioning member and the second positioning member and the second outer yoke, whereby a speaker device can be realized having a configuration wherein the first inner yoke and the second inner yoke sandwiching the magnet, the first outer yoke and the second outer yoke, and the voice coil unit having a first voice coil portion and a second voice coil portion are integrated with the first positioning member and the second positioning member.

Also, the speaker device may have a configuration wherein the first-first supporting unit that elastically supports one end portion of the first voice coil unit and the first-second supporting unit that elastically supports one end portion of the second voice coil portion are formed so as to be continuous, and the border portion between the first-first supporting unit and the first-second supporting unit is fixed to the first positioning member; and the second-first supporting unit that elastically supports the other end portion of the first voice coil unit and the second-second supporting unit that elastically supports the other end portion of the second voice coil portion are formed so as to be continuous, and the border portion between the second-first supporting unit and the second-second supporting unit is fixed to the second positioning member.

With such a configuration, the first-first supporting unit which elastically supports one end portion of the first voice coil portion and the first-second supporting unit which elastically supports one end portion of the second voice coil portion that are formed so as to be continuous are fixed to the first positioning member in a common manner at the border portions thereof, and the second-first supporting unit which elastically supports an other end portion of the first voice coil portion and the second-second supporting unit which elastically supports an other end portion of the second voice coil portion that are formed so as to be continuous are fixed to the second positioning member in a common manner at the border portions thereof, whereby the voice coil unit having a first voice coil portion and a second voice coil portion can be fixed by the first positioning unit and the second positioning unit with a simple configuration.

The speaker device may have a configuration further including a frame member that contains the first positioning member and the second positioning member; the first inner yoke and the second inner yoke that are subjected to positioning by the first positioning member and the second positioning member and that sandwich the magnet; the first outer yoke and the second outer yoke that are subjected to positioning by the first positioning member and the second positioning member; and a voice coil unit wherein the first-first supporting unit, the second-first supporting unit, the first-second supporting unit, and the second-second supporting unit which elastically support the first voice coil portion and the second voice coil portion are fixed to the first positioning member and the second positioning member.

With such a configuration, the first inner yoke and the second inner yoke sandwiching the magnet, the first outer yoke and the second outer yoke, and the voice coil unit are contained in the frame member in a state of being integrated with the first positioning member and the second positioning member.

The speaker device may have a configuration further including: a damper member; wherein the damper member is formed between an edge portion fixed to a first outer edge portion of the frame member that extends between the first positioning member and the second positioning member along a magnetic gap that is formed between the first outer yoke and each of the first inner yoke and the second inner yoke, and an edge portion fixed to a second outer edge portion of the frame member that extends between the first positioning member and the second positioning member along a magnetic gap that is formed between the second outer yoke and each of the first inner yoke and the second inner yoke; wherein the speaker device further has a damper member formed between an edge portion fixed to the first outer edge portion of the frame member and an edge portion fixed to the second outer edge portion of the frame member; wherein the first voice coil portion and one end portion of the diaphragm are fixed to predetermined positions on the first outer edge portion side of the frame member of the damper member; and the second voice coil portion and the other end portion of the diaphragm are fixed to predetermined positions on the second outer edge portion side of the frame member of the damper member.

With a configuration such as described above, both edge portions can be fixed by sliding to fit the first outer edge portion and second outer edge portion of the frame member, and one end portion of the diaphragm can be fixed by sliding to fit into the predetermined position of the first outer edge portion side of the frame member of the damper member, and the other end portion of the diagram can be fixed by sliding to fit into the predetermined position of the second outer edge portion side of the frame member of the damper member. With such a configuration, the use of adhesive agent can be suppressed.

A speaker device according to a third embodiment of the present invention has a configuration including: a magnet; an outer yoke; an inner yoke integrally forming a magnetic circuit with the magnet and the outer yoke so as to form a magnetic gap between the outer yoke and the inner yoke, such that a magnetic flux from the magnet cuts across the gap; a diaphragm; a voice coil unit linked to the diaphragm, disposed within the magnetic gap; a linking unit, formed on the outer yoke, to link an end portion of the first outer yoke portion and the second outer yoke portion with the first outer yoke portion and the second outer yoke portion that are disposed so as to face one another, the outer yoke being formed to have a roughly U-shaped cross-section; and positioning members to determine the positions of the inner yoke, and the outer yoke which sandwiches the magnet with the inner yoke by the linking unit, with regard to a spacing of a magnetic gap, such that a magnetic gap is formed between each of one side end face of the inner yoke and the first outer yoke portion, and the other side end face of the inner yoke and the second outer yoke portion.

With such a configuration, the inner yoke, and the outer yoke are assembled in a state wherein the inner yoke and the outer yoke (first outer yoke, second outer yoke, and linking unit) that sandwich the magnet are subjected to positioning so that the magnetic gap is formed.

The speaker device may have a configuration wherein the positioning member has an inner yoke positioning-determining unit to determine the position of the inner yoke; and a spacer unit to hold the spacing between both side end faces of the inner yoke subjected to positioning by the inner yoke positioning unit and the first outer yoke portion and the second outer yoke portion of the outer yoke, to the spacing of the magnetic gap.

With such a configuration, a magnetic gap can be formed that is determined by spacer units between the inner yoke subjected to positioning by the inner yoke positioning unit of the positioning member and the first outer yoke portion of the outer yoke, and between the inner yoke and the second outer yoke portion of the outer yoke.

The speaker device may have a configuration wherein the voice coil unit has a first voice coil portion formed on the surface of a flexible material in a first voice coil array pattern; a second voice coil portion formed on the surface of a flexible material in a second voice coil array pattern; a first supporting unit that is formed following the first voice coil portion on the flexible material and that elastically supports the first voice coil portion; a second supporting unit that is formed following the second voice coil portion on the flexible material and that elastically supports the second voice coil portion; wherein the first supporting unit is fixed to the positioning member so that the first voice coil portion is disposed in the magnetic gap formed between the inner yoke and the first outer yoke portion of the outer yoke; and wherein the second supporting unit is fixed to the positioning member so that the second voice coil portion is disposed in the magnetic gap formed between the inner yoke and the second outer yoke portion of the outer yoke.

With such a configuration, the first voice coil portion elastically supported by the first supporting unit that is fixed to the positioning member is disposed in the magnetic gap formed between the inner yoke and the first outer yoke portion of the outer yoke that are subjected to positioning by the positioning member, and the second voice coil portion elastically supported by the second supporting unit that is fixed to the positioning member is disposed in the magnetic gap formed between the inner yoke and the second outer yoke portion of the outer yoke that are subjected to positioning by the positioning member, whereby a speaker device can be realized having a configuration wherein the inner yoke and the outer yoke (first outer yoke portion, second outer yoke portion, and linking unit) having sandwiched the magnet, and the voice coil unit having the first voice coil portion and the second voice coil portion are integrated with the positioning member.

The speaker device may have a configuration having a first positioning member serving as the positioning member that engages with one end portion of the inner yoke and one end portion of the outer yoke so that a magnetic gap is formed between the inner yoke and each of the first outer yoke portion and the second outer yoke portion of the outer yoke; and a second positioning member serving as the positioning member that engages with the other end portion of the inner yoke and the other end portion of the outer yoke so that a magnetic gap is formed between the inner yoke and each of the first outer yoke portion and the second outer yoke portion of the outer yoke.

With such a configuration, the first positioning member and second positioning member determine the positions of the inner yoke and the outer yoke with both end portions thereof, so that a magnetic gap is formed between the inner yoke and the first outer yoke portion of the outer yoke, and between the inner yoke and second outer yoke portion of the outer yoke.

The speaker device may have a configuration wherein the voice coil unit has a first voice coil portion formed on the surface of a flexible material in a first voice coil array pattern; a second voice coil portion formed on the surface of a flexible material in a second voice coil array pattern; a first-first supporting unit and a second-first supporting unit that are formed following both end portions of the first voice coil portion on the flexible material and that elastically supports the first voice coil portion; and a first-second supporting unit and a second-second supporting unit that are formed following both end portions of the second voice coil portion on the flexible material and that elastically supports the second voice coil portion; wherein the first-first supporting unit and the second-first supporting unit are fixed to the first positioning member and the second positioning member so that the first voice coil portion is disposed in the magnetic gap formed between the inner yoke and the first outer yoke portion of the outer yoke; and wherein the first-second supporting unit and the second-second supporting unit are fixed to the first positioning member and the second positioning member so that the second voice coil portion is disposed in the magnetic gap formed between the inner yoke and the second outer yoke portion of the outer yoke.

With such a configuration, the first voice coil portion of which both end portions are elastically supported by the first-first supporting unit and the second-first supporting unit fixed to the first positioning member and the second positioning member is disposed in the magnetic gap formed between each of the inner yoke and the first outer yoke portion of the outer yoke subjected to positioning by the first positioning member and the second positioning member, and the second voice coil portion of which both end portions are elastically supported by the first-second supporting unit and the second-second supporting unit fixed to the first positioning member and the second positioning member is disposed in the magnetic gap formed between each of the inner yoke and the second outer yoke portion of the outer yoke subjected to positioning by the first positioning member and second positioning member, whereby a speaker device can be realized having a configuration wherein the inner yoke and the outer yoke (first outer yoke portion, second outer yoke portion, linking unit) sandwiching the magnet and the voice coil unit having a first voice coil portion and a second voice coil portion are integrated with the first positioning member and the second positioning member.

The speaker device may have a configuration wherein the first-first supporting unit that elastically supports one end portion of the first voice coil unit and the first-second supporting unit that elastically supports one end portion of the second voice coil portion are formed so as to be continuous, and the border portion between the first-first supporting unit and the first-second supporting unit is fixed to the first positioning member; and the second-first supporting unit that elastically supports the other end portion of the first voice coil unit and the second-second supporting unit that elastically supports the other end portion of the second voice coil portion are formed so as to be continuous, and the border portion between the second-first supporting unit and the second-second supporting unit is fixed to the second positioning member.

With such a configuration, the first-first supporting unit which elastically supports one end portion of the first voice coil portion and the first-second supporting unit which elastically supports one end portion of the second voice coil portion that are formed so as to be continuous are fixed to the first positioning member in a common manner at the border portion thereof, and the second-first supporting unit which elastically supports an other end portion of the first voice coil portion and the second-second supporting unit which elastically supports an other end portion of the second voice coil portion that are formed so as to be continuous are fixed to the second positioning member in a common manner at the border portion thereof, whereby the voice coil unit having a first voice coil portion and a second voice coil portion can be fixed by the first positioning unit and the second positioning unit with a simple configuration.

The speaker device may have a configuration having a first frame member fixed to an end portion on the opposite side from the end portion to which the linking unit of the first outer yoke portion of the outer yoke connects; a second frame member fixed to an end portion on the opposite side from the end portion to which the linking unit of the second outer yoke portion of the outer yoke connects; and a damper member formed between an edge portion fixed to the first frame member and an edge portion fixed to the second frame member; wherein the first voice coil portion and one end portion of the diaphragm is fixed to a predetermined position on the first frame member side of the damper member; and the second voice coil portion and the other end portion of the diaphragm is fixed to a predetermined position on the second frame member side of the damper member.

With a configuration such as described above, both edge portions can be fixed by sliding to fit the first frame member and the second frame member, and one end portion of the diaphragm can be fixed by sliding to fit onto the predetermined position of the first frame member side of the damper member, and the other end portion of the diagram is fixed by sliding to fit onto the predetermined position of the second frame member side of the damper member.

With such a configuration, the use of an adhesive agent can be suppressed.

With the speaker device according to the above-described configurations, the magnet, the outer yoke and the inner yoke are assembled in a state wherein the inner yoke and the outer yoke are subjected to positioning by the positioning members so that a magnetic gap is formed, whereby the magnetic circuit can be assembled with good workability with the positioning members. Also, the positions of the inner yoke and the outer yoke are determined by the positioning members, whereby even if position fixing force by an adhesive agent of the inner yoke and the outer yoke is reduced, position shifting can be prevented, whereby disassembly of the magnetic circuit is made easy, and individual recycling of the various part in the magnetic circuit including the inner yoke and the outer yoke becomes relatively easy.

DESCRIPTION OF THE PREFERRED EMBODIMENTS

Embodiments of the present invention will be described below with reference to the appended diagrams. An external view of a speaker device according to a first embodiment of the present invention is as shown in FIG. 1.

Figure 1:
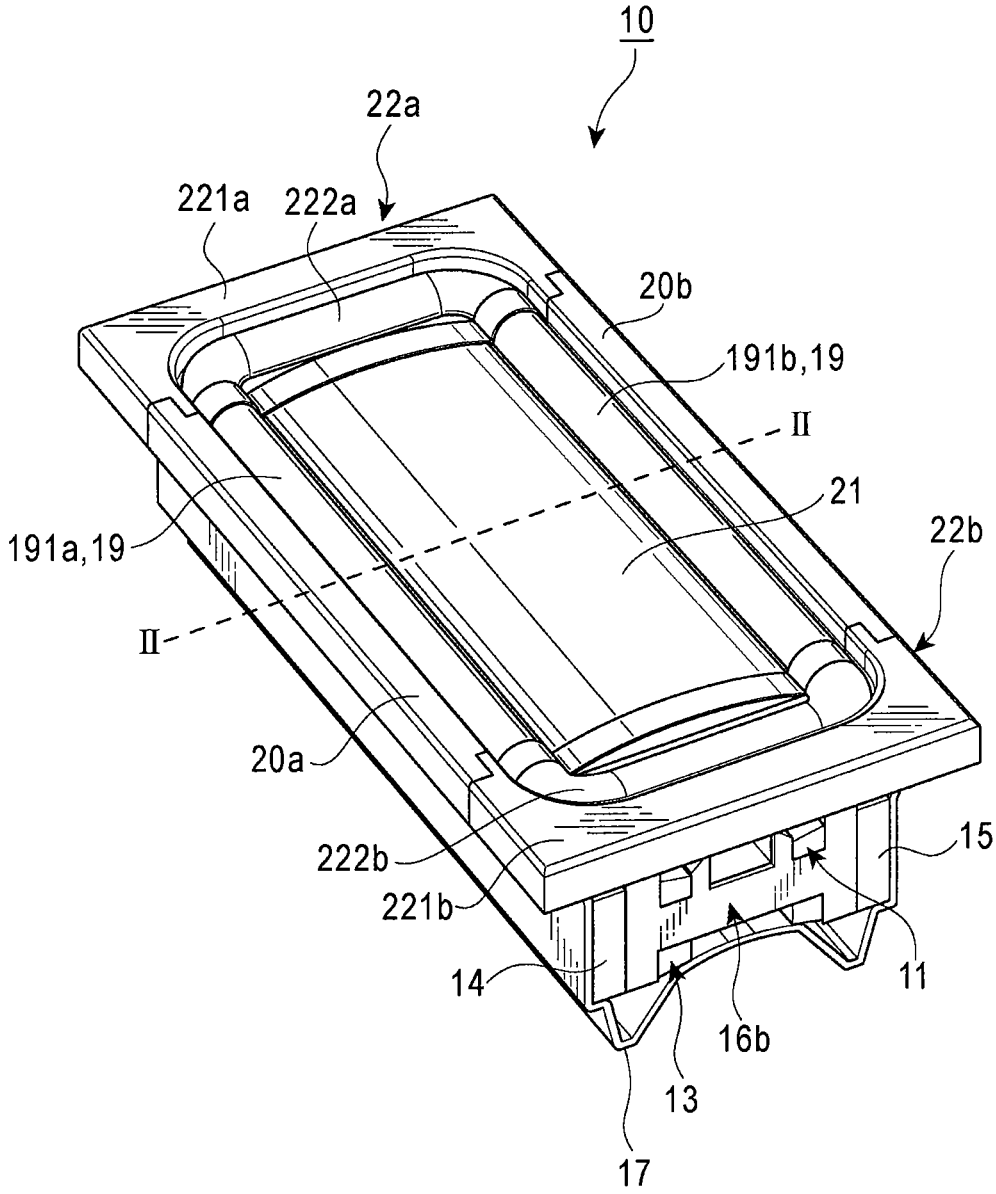
FIG. 1 is a perspective diagram illustrating the external view of a speaker device according to an embodiment of the present invention.
Figure 2:
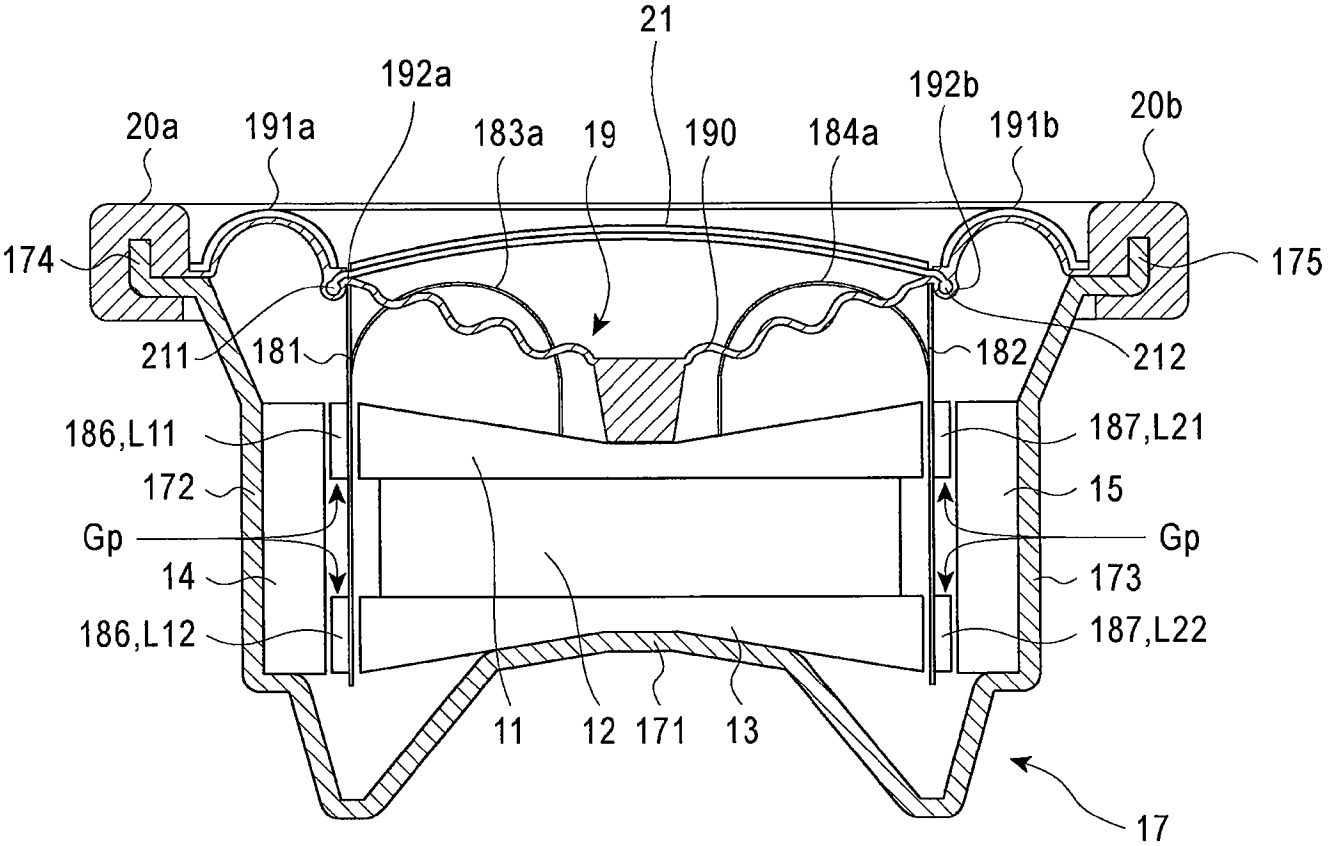
FIG. 2 is a cross-sectional diagram showing a cross-sectional configuration of the speaker device shown in FIG. 1 cut away at line II-II.

A speaker device 10 shown in FIG. 1 is an angular shaped speaker device, is configured with the parts shown in FIGS. 3 through 12, and has the cross-sectional configuration as shown in FIG. 2. Specifically, the speaker device 10 is formed by assembling the various parts of a rectangular plate-shaped metallic first inner yoke 11 shown in FIG. 3, a rectangular plate-shaped magnetic plate 12 shown in FIG. 4, a rectangular plate-shaped metallic second inner yoke 13 shown in FIG. 5, a first position-determining member 16*a* made of a non-magnetic body (for example, a resin) shown in FIG. 6A, a second positioning member 16*b* made of a non-magnetic body (for example, a resin) shown in FIG. 6B, a first outer yoke 14 and a second outer yoke 15 shown in FIG. 7, a frame member 17 shown in FIG. 8, a voice coil unit 18 shown in FIG. 9, a damper member 19 shown in FIG. 10, a diaphragm 21 shown in FIG. 11, and a first horizontal edge unit 22*a* and a second horizontal edge unit 22*b* shown in FIG. 12.

Figure 3:
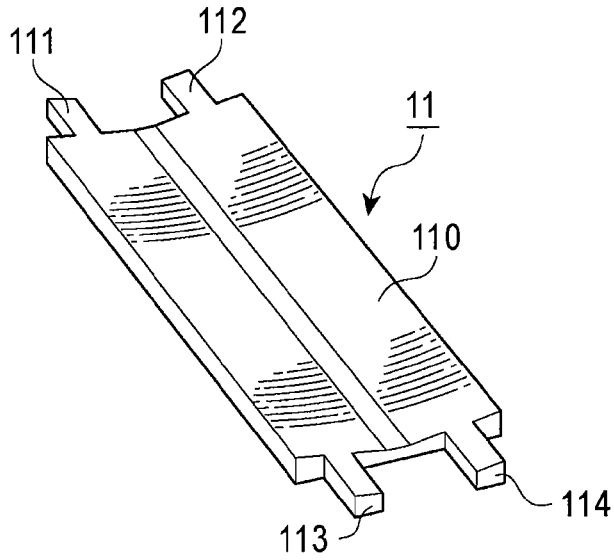
FIG. 3 is a perspective diagram showing a configuration of a first inner yoke.
Figure 4:
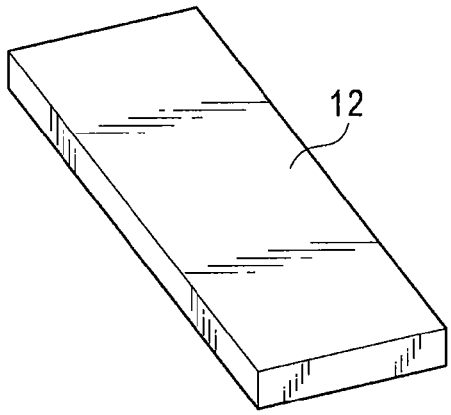
FIG. 4 is a perspective diagram illustrating a magnetic plate.
Figure 5:
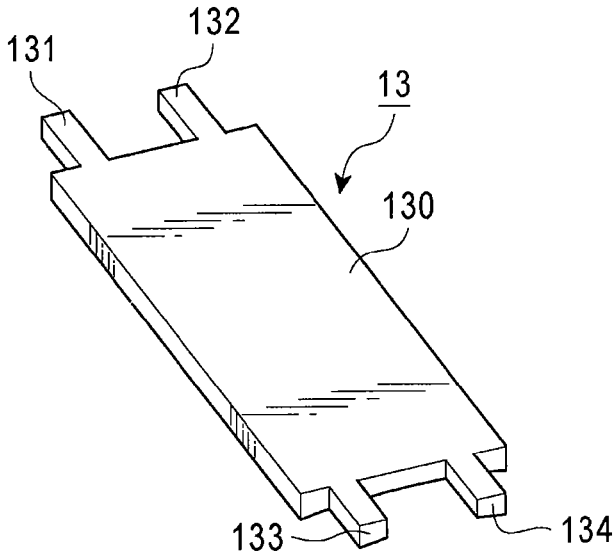
FIG. 5 is a perspective diagram illustrating a configuration of a second inner yoke.

The first inner yoke 11 (second inner yoke 13) shown in FIG. 3 (FIG. 5) has a configuration wherein positioning protrusions 111 and 112 (131 and 132) are formed as a pair on one end portion of the lengthwise direction of the rectangular plate-shaped yoke main unit 110 (130), while positioning protrusions 113 and 114 (133 and 134) are formed as a pair on the other end portion. Spacing of each pair of positioning protrusions 111, 112 (131, 132) (113, 114) (133, 134), specifically, the distance between the external side faces, are set to predetermined lengths. The magnetic plate 12 shown in FIG. 4 is formed as a rectangular plate shape having a plate face with a slightly smaller area than the plate faces of the yoke main units 110, 130 of each of the first inner yoke 11 and the second inner yoke 13.

Figure 6A:
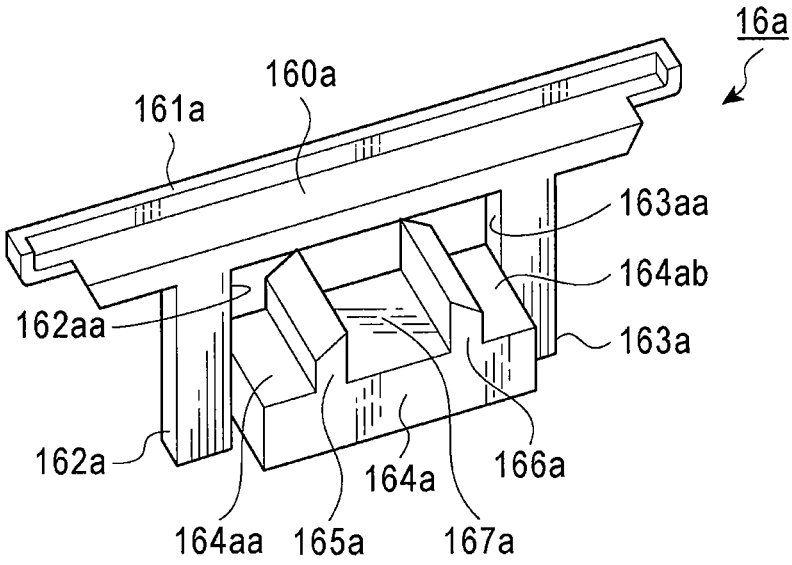
FIG. 6A is a perspective diagram illustrating a configuration of a first positioning member.
Figure 6B:
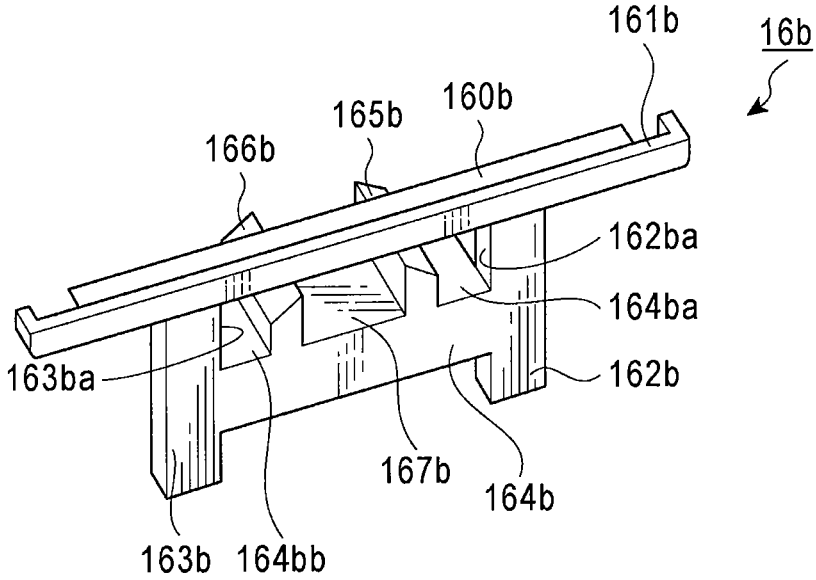
FIG. 6B is a perspective diagram illustrating a configuration of a second positioning member.

The first positioning member 16*a* shown in FIG. 6A and the second positioning member 16*b* shown in FIG. 6B are used to determine the positions of the first inner yoke 11, the second inner yoke 13, the first outer yoke 14, and the second outer yoke 15. The configuration of the first positioning member 16*a* will be described below, and the second positioning member 16*b* has the same configuration thereof. In FIG. 6A (FIG. 6B), an angular-rod shaped first horizontal spacer unit 162*a* (162*b*) and second horizontal spacer unit 163*a* (163*b*) are formed on a horizontal bar 160*a* (160*b*) so as to extend down therefrom. The spacing of the inner face 162*aa* (162*ba*) of the first horizontal spacer unit 162*a* (162*b*) and the inner face 163*aa* (163*ba*) of the second horizontal spacer unit 163*a* (163*b*) is set to the same distance as between the outer side face of the protrusion pairs 111, 112 (131, 132), (113, 114), (133, 134) of each of the above-described first inner yoke 11 and second inner yoke 13. Also, the width in the horizontal direction for each of the first horizontal spacer unit 162*a* (162*b*) and the second horizontal spacer unit 163*a* (163*b*) is set to a value corresponding to spacing that the spacers should have. Note that the width herein is determined, taking into account the horizontal width of each of the first inner yoke 11 and the second inner yoke 13 and the magnetic gap Gp that is to be formed.

A rectangular-shaped vertical spacer unit 164*a* (164*b*) is formed between the first horizontal spacer unit 162*a* (162*b*) and the second horizontal spacer unit 163*a* (163*b*), so as to connect the roughly center portion thereof in the vertical direction of the respective inner faces 162*aa* (162*ba*), 163*aa* (163*ba*) thereof. The thickness in the vertical direction of the vertical spacer unit 164*a* (164*b*) is set to a value that corresponds to the spacing that the spacer should have. Note that this thickness is determined taking into account the spacing that the first inner yoke 11 and the second inner yoke 13 are to maintain, i.e. the thickness of the magnetic plate 12. Two protruding portions 165*a* (165*b*) and 166*a* (166*b*) are formed on the upper face of the vertical spacer unit 164*a* (164*b*), so as to extend in the direction orthogonal to the direction that the horizontal bar 160*a* (160*b*) extends, and in the form whereby the upper outer edges are chamfered. The two protruding portions 165*a* (165*b*) and 166*a* (166*b*) are positioned symmetrically on the right and left of the center of the upper face of the vertical spacer unit 164*a* (164*b*), at a predetermined spacing. With the two protruding portions 165*a* (165*b*) and 166*a* (166*b*), the upper face of the vertical spacer unit 164*a* (164*b*) is divided into three portions. The portion between the two protruding portions 165*a* (165*b*) and 166*a* (166*b*) becomes a terminal set face 167*a* (167*b*) wherein the terminal unit of the voice coil unit 18 is set, as described later, the portion between one of the protruding portions 165*a* (165*b*) and the first horizontal spacer unit 162*a* (162*b*) becomes a first positioning face 164*aa* (164*ba*) for determining the position of the first inner yoke 11, and further, the portion between the other protruding portion 166*a* (166*b*) and the second horizontal spacer unit 163*a* (163*b*) becomes a second positioning face 164*ab* (164*bb*) for determining the position of the first inner yoke 11. The spacing between one of the protruding portions 165*a* (165*b*) and the first spacer unit 162*a* (162*b*) is set so as to correspond to the width of the positioning protrusion 111 (114) of the first inner yoke 11, and the spacing between the other protrusion 166*a* (166*b*) and the second spacer unit 163*a* (163*b*) is set so as to correspond to the width of the positioning protrusion 112 (113) of the first inner yoke 11. The lower face of the vertical spacer unit 164*a* (164*b*) which is on the opposite side from the upper face that is divided into three parts as described above becomes the positioning face to determine the position of the second inner yoke 13.

Note that an integrated outer frame unit 161*a* (161*b*) is formed on the horizontal bar 160*a* (160*b*). The outer frame unit 161*a* (161*b*) is linked to the first outer edge portion 174 and the second outer edge portion 175 of the frame member 17 to be described later, and forms an overall rectangular-shaped frame unit.

Figure 7:
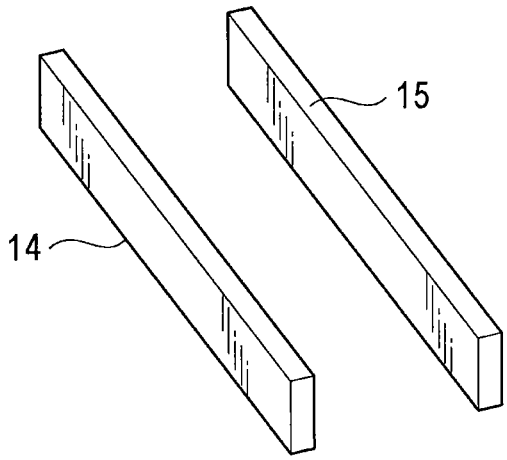
FIG. 7 is a perspective diagram illustrating a first outer yoke and second outer yoke as a pair.
Figure 8:
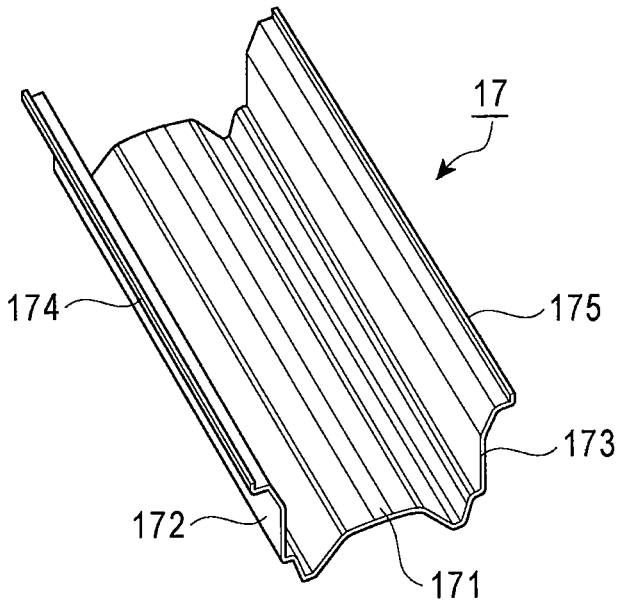
FIG. 8 is a perspective diagram illustrating a configuration of a frame member.

The first outer yoke 14 and the second outer yoke 15 shown in FIG. 7 are in rectangular plate shapes, and along with the first inner yoke 11, the second inner yoke 13, and the magnetic plate 12, make up the magnetic circuit. The frame member 17 shown in FIG. 8 is formed by extrusion molding of metal or resin, and has a floor portion 171 having an arch shape on the inner side, a first pressing unit 172 that stands up following one of the end portions of the floor portion 171 and that is to press the first outer yoke 14 as will be described later, a second pressing unit 173 that stands up following the other end portion of the floor portion 171 and that is to press the second outer yoke 15 as will be described later, a first outer edge portion 174 formed following the first pressing unit 172, and a second outer edge portion 175 formed following the second pressing unit 173. The first outer edge portion 174 and the second outer edge portion 175 link with the outer frame portions 161*a* and 161*b* (see FIGS. 6A, 6B) of the first positioning member 16*a* and the second positioning member 16*b* as described above, to form the overall rectangular-shaped frame unit.

Figure 9:
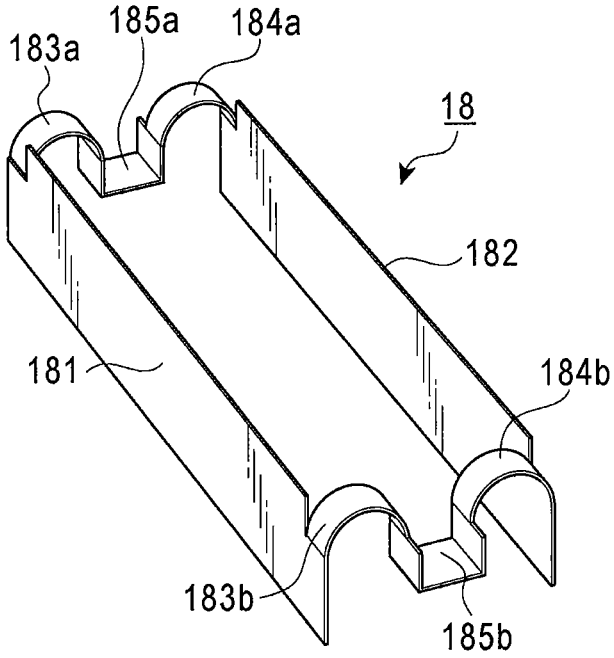
FIG. 9 is a perspective diagram illustrating a configuration of a voice coil unit.

The voice coil unit 18 shown in FIG. 9 is of a configuration having a first voice coil portion 181 that is formed in a first voice coil array pattern on the surface of a flexible board, a second voice coil portion 182 that is formed in a second voice coil array pattern on the surface of the flexible board, a first-first supporting unit 183*a* that is formed following one edge portion of the first voice coil portion 181 and that is in a bent state and elastically supports the one edge portion of the first voice coil portion 181, a second-first supporting unit 183*b* that is formed following the other edge portion of the first voice coil portion 181 and that is in a bent state and elastically supports the other edge portion of the first voice coil portion 181, a first-second supporting unit 184*a* that is formed following one edge portion of the second voice coil portion 182 and that is in a bent state and elastically supports the one edge portion of the second voice coil portion 182, a second-second supporting unit 184*b* that is formed following the other edge portion of the second voice coil portion 182 and that is in a bent state and elastically supports the other edge portion of the second voice coil portion 182. The first-first supporting unit 183*a* that elastically supports the one edge portion of the first voice coil portion 181 and the first-second supporting unit 184*a* that elastically supports the one edge portion of the second voice coil portion 182 are formed so as to be continuous, and the border portion thereof becomes a first terminal unit 185*a* having a U-shaped cross-section. Also, the second-first supporting unit 183*b* that elastically supports the other edge portion of the first voice coil portion 181 and the second-second supporting unit 184*b* that elastically supports the other edge portion of the second voice coil portion 182 are formed so as to be continuous, and the border portion thereof becomes a second terminal unit 185*b* having a U-shaped cross-section.

With the voice coil unit 18 shown in FIG. 9, the first terminal unit 185*a* and the second terminal unit 185*b* are maintained horizontally, and the first-first supporting unit 183*a* and the second-first supporting unit 183*b* that follow the one side of the first terminal unit 185*a* and the second terminal unit 185*b* are in a bent state and follow both ends of the first voice coil portion 181 of which the surface is maintained orthogonally. Also, the first-second supporting unit 184*a* and the second-second supporting unit 184*b* that follow the other side of the first terminal unit 185*a* and the second terminal unit 185*b* are in a bent state and follow both ends of the second voice coil portion 182 of which the surface is maintained orthogonally. Thus, the first voice coil portion 181 that is elastically supported with the first-first supporting unit 183*a* and the second-first supporting unit 183*b* can vibrate in the orthogonal direction, and the second voice coil portion 182 that is elastically supported with the first-second supporting unit 184*a* and the second-second supporting unit 184*b* can vibrate in the orthogonal direction.

Figure 13A:
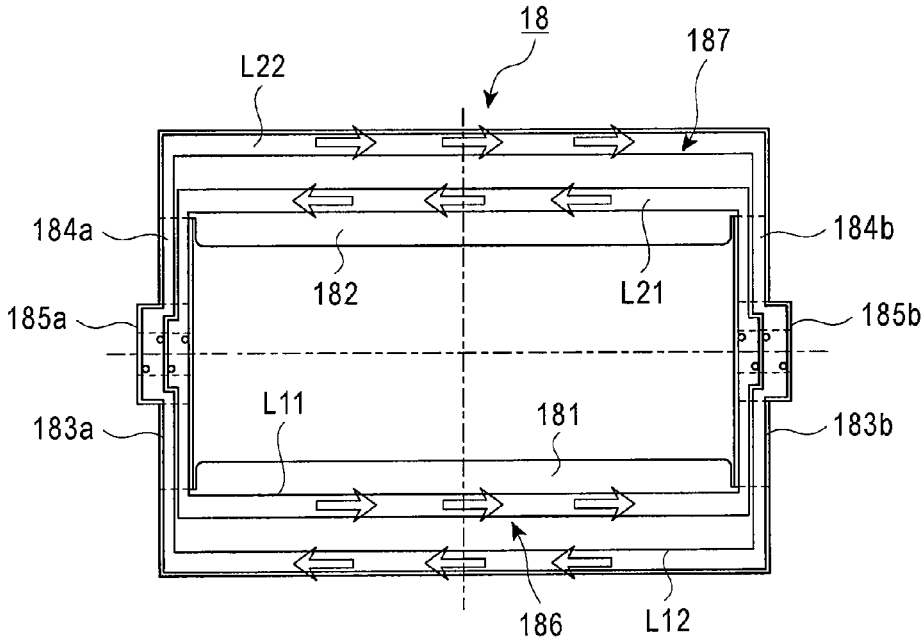
FIG. 13A is a plan view illustrating an example of a voice coil array pattern formed in the voice coil unit.

The voice coil unit 18 in a state that is laid out flat is shown in FIG. 13A. In FIG. 13A, a line pattern L11 is formed from the first terminal unit 185*a* through the first-first supporting unit 183*a*, the first voice coil portion 181 and the second-first supporting unit 183*b* to the second terminal unit 185*b*, and a line pattern L21 is formed from the second terminal unit 185*b* through the second-second supporting unit 184*b*, the second voice coil portion 182, and the first-second supporting unit 184*a*, following the line pattern L11, to return to the line pattern L11 of the first terminal unit 185*a*. That is to say, the line patterns L11 and L21 are formed circularly between the first terminal unit 185*a*, the first-first supporting unit 183*a*, the first voice coil portion 181, the second-first supporting unit 183*b*, the second terminal unit 185*b*, the second-second supporting unit 184*b*, the second voice coil portion 182, and the first-second supporting unit 184*a*. Also, on the outer side of the line patterns L11 and L21 which connect circularly, a line pattern L12 is formed from the first terminal unit 185*a* through the first-first supporting unit 183*a*, the first voice coil portion 181 and the second-first supporting unit 183*b* to the second terminal unit 185*b*, and a line pattern L22 is formed from the second terminal unit 185*b* through the second-second supporting unit 184*b*, the second voice coil portion 182, and the first-second supporting unit 184*a*, following the line pattern L12, to return to the line pattern L12 of the first terminal unit 185*a*. That is to say, the line patterns L12 and L22 are similarly formed circularly on the outer side of the line patterns L11 and L21 which connect circularly.

For example, two pairs of connecting points are formed on the first terminal unit 185*a*, and an audio signal is supplied to one pair of connecting points so that audio signal current flows to the line pattern L11 formed in the first voice coil portion 181 and the line pattern L21 formed in the second voice coil portion 182. Also, an audio signal is supplied to the other pair of connecting points so that audio signal current flows in the opposite direction from the audio current that flows in line patterns L11 and L21, to the line pattern L12 formed in the first voice coil portion 181 and the line pattern L22 formed in the second voice coil portion 182.

By forming the voice coil unit 18 of a laid-open configuration as shown in FIG. 13A to be in a form shown in FIG. 9, two line patterns L11 and L12 are arrayed above and below in the first voice coil portion 181, and a first voice coil line pattern 186 is configured with these line patterns L11 and L12. Also, two line patterns L21 and L22 are arrayed above and below in the second voice coil portion 182, and a second voice coil line pattern 187 is configured with these line patterns L21 and L22.

Figure 13B:
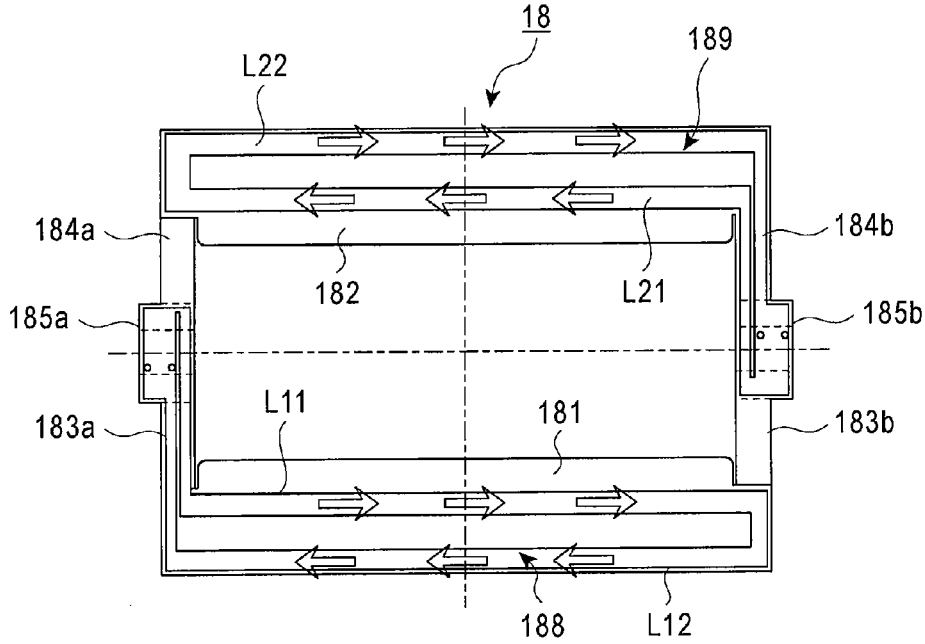
FIG. 13B is a plan view illustrating another example of a voice coil array pattern formed in the voice coil unit.

A line pattern such as shown in FIG. 13B can also be formed on the voice coil unit 18. In FIG. 13B which shows the voice coil unit 18 in a state that is laid out flat, a line pattern L11 is formed from the first terminal unit 185*a* through the first-first supporting unit 183*a* and the first voice coil portion 181 to the end portion of the first voice coil unit 181, and a line pattern L12 is formed from the end portion of the first voice coil portion 181, following the line pattern L11, through the first voice coil portion 181 and the first-first supporting unit 183*a*, to return to the first terminal unit 185*a*. That is to say, the line patterns L11 and L12 are formed in a ring shape to the first terminal unit 185*a*, the first-first supporting unit 183*a*, and the first voice coil portion 181. Also, a line pattern L21 is formed from the second terminal unit 185*b* through the second-second supporting unit 184*b* and the second voice coil portion 182, to the end portion of the second voice coil unit, and a line pattern L22 is formed from the end portion of the second voice coil portion 182, following the line pattern L21, through the second voice coil portion 182 and the second-second supporting unit 184*b*, to return to the second terminal unit 185*b*. That is to say, the line patterns L21 and L22 are formed in a ring shape to the second terminal unit 185*b*, the second-second supporting unit 184*b*, and the second voice coil portion 182.

A pair of connecting points is formed on the first terminal unit 185*a*, and an audio signal is supplied to the connecting points making up this pair, whereby audio current flows in the opposite direction of the line patterns L11 and L12 that are formed in a ring shape. Also, a pair of connecting points is formed on the second terminal unit 185*b*, and an audio signal is supplied to the connecting points making up this pair, whereby audio current flows in the opposite direction of the line patterns L21 and L22 that are formed in a ring shape.

In the case that the voice coil unit 18 in the laid-open configuration as shown in FIG. 13B is formed into a shape shown in FIG. 9, two line patterns L11 and L12 are arrayed above and below in the first voice coil portion 181, similar to the case of the voice coil unit 18 in the configuration shown in FIG. 13A, and the first voice coil line pattern 188 is configured by the line patterns L11 and L12. Also, two line patterns L21 and L22 are arrayed above and below in the second voice coil portion 182, and the second voice coil line pattern 189 is configured by the line patterns L21 and L22.

Figure 10:
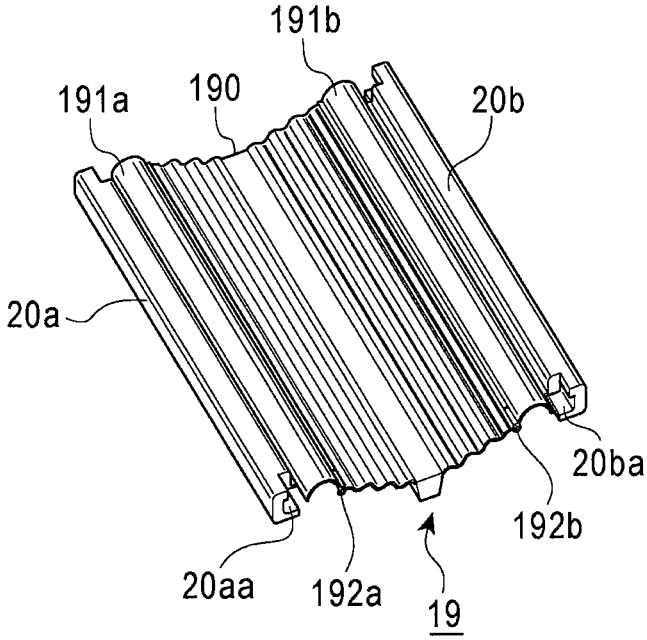
FIG. 10 is a perspective diagram illustrating a configuration of a damper member.

The damper member 19 shown in FIG. 10 is formed by extrusion molding of resin, and has a damper main unit 190 formed in a wave form, a first supporting unit 191*a* formed in an arch shape that follows one of the outer side edge portions of the damper main unit 190, and a second supporting unit 191*b* formed in an arch shape that follows the other outer side edge portions of the damper main unit 190. A first fitting groove 192*a* is formed in the border portion of the damper main unit 190 and first supporting unit 191*a* so as to extend in the lengthwise direction, and a second fitting groove 192*b* is formed in the border portion of the damper main unit 190 and second supporting unit 191*b* so as to extend in the lengthwise direction.

Also, a first vertical edge portion 20*a* is formed following the outer side of the first supporting unit 191*a*, and a second vertical edge portion 20*b* is formed following the outer side of the second supporting unit 191*b*. A first fitting groove 20*aa* and a second fitting groove 20*ba* are formed in the first vertical edge portion 20*a* and the second vertical edge portion 20*b* so as to extend in the lengthwise direction.

Figure 11:
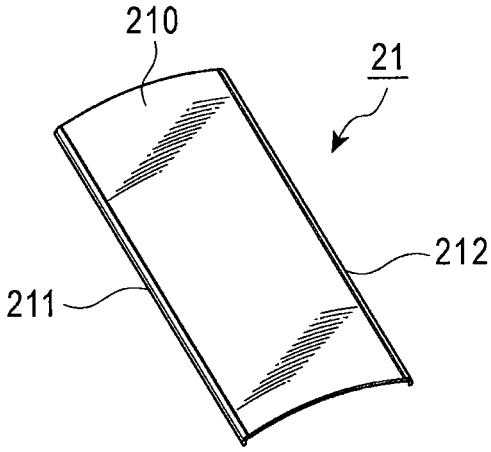
FIG. 11 is a perspective diagram illustrating a diaphragm.

The diaphragm 21 shown in FIG. 11 is formed with a material such as resin, metal, paper, or the like, and has a diaphragm main unit 210 that is in a slightly bent state and a first slide unit 211 and a second slide unit 212 that slide and fit into the first fitting groove 192*a* and the second fitting groove 192*b* of the damper member 19 on both outer edges of the diaphragm main unit 210.

Figure 12:
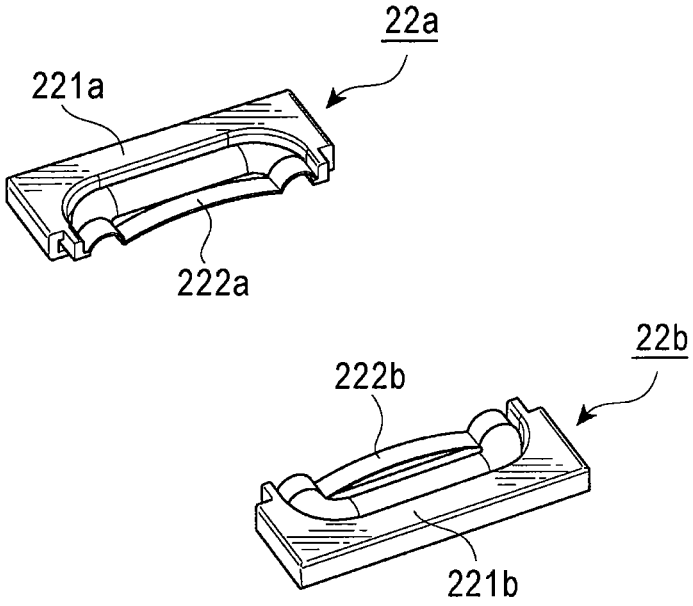
FIG. 12 is a perspective diagram illustrating a first horizontal edge portion and second horizontal edge portion.

The first horizontal edge portion 22*a* and the second horizontal edge portion 22*b* shown in FIG. 12 are formed with a resin or the like, and as described above, has outer frame units 161*a* and 161*b* of the first positioning member 16*a* and the second positioning member 16*b*, and edge engaging portions 221*a* and 221*b* that engage so as to link to the first vertical edge portion 20*a* and the second vertical edge portion 20*b* that are fixed in the first outer edge portion 174 and the second outer edge portion 175 on both end portions in the lengthwise direction of the rectangular-shaped frame unit formed by the first outer edge portion 174 and the second outer edge portion 175 of the frame member 17 linking together. Also, edge cover portions 222*a* and 222*b* that fill in the spaces between the diaphragm 19 are formed so as to extend over the inner side of the edge engaging portions 221*a* and 221*b*.

The parts configured as described above (see FIGS. 3 through 12) are assembled as follows, whereby the speaker device 10 shown in FIG. 1 is formed.

Figure 14:
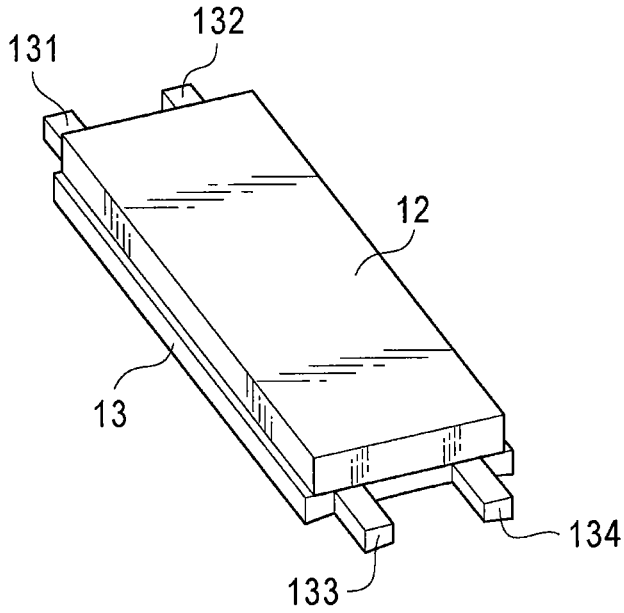
FIG. 14 is a perspective diagram illustrating a configuration unit formed by layering a magnetic plate over the second inner yoke.
Figure 15:
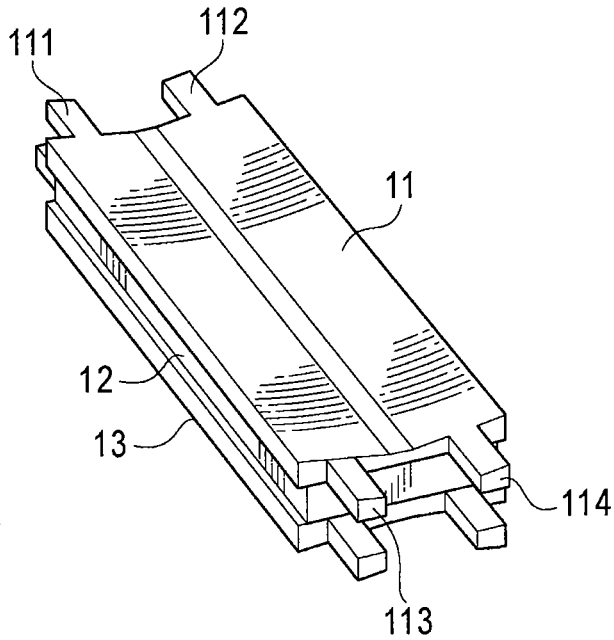
FIG. 15 is a perspective diagram illustrating a configuration unit formed by sandwiching a magnetic plate between the first inner yoke and second inner yoke.
Figure 16:
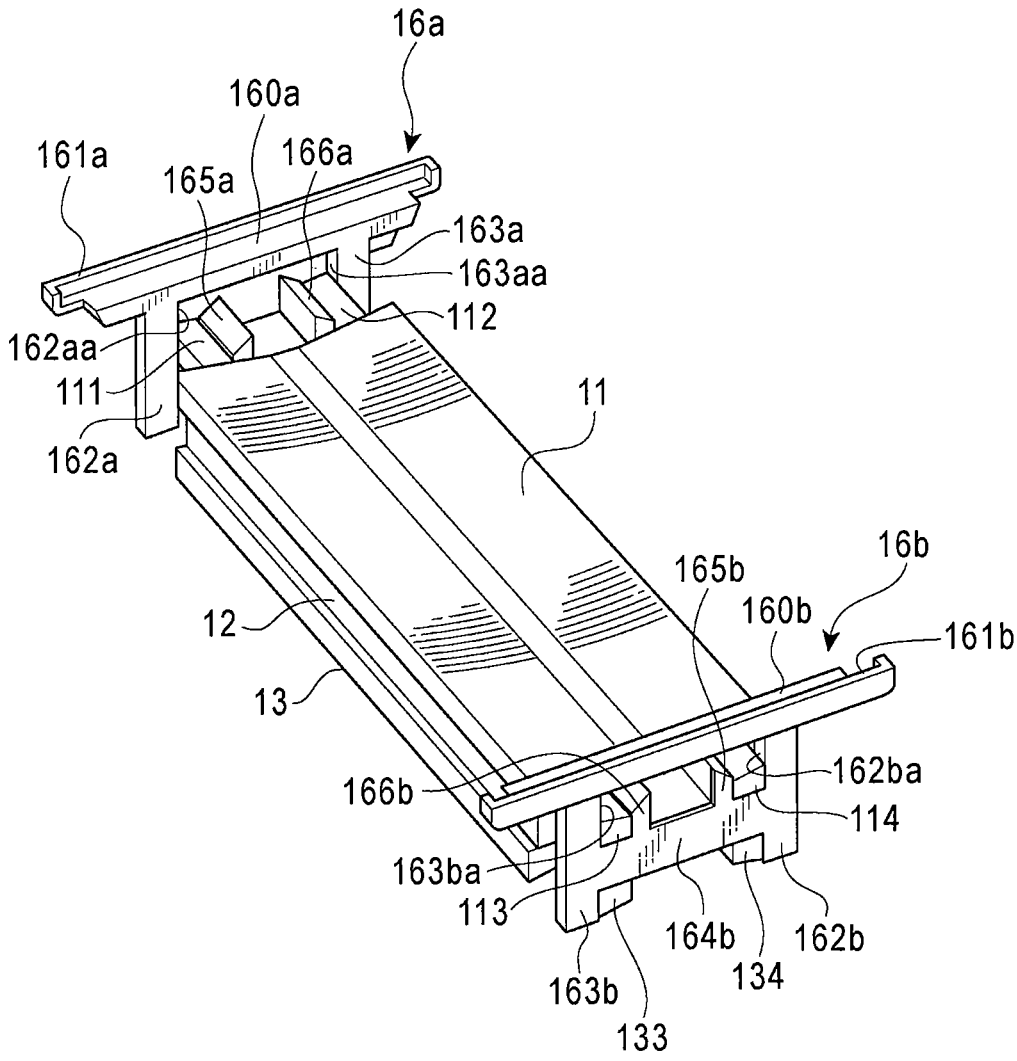
FIG. 16 is a perspective diagram illustrating a new configuration unit formed by attaching the configuration unit shown in FIG. 15 to the first positioning member and the second positioning member.

As shown in FIG. 14, a magnetic plate 12 is layered over a second inner yoke 13, and further, as shown in FIG. 15, a second inner yoke 11 is layered over the magnetic plate 12, whereby the magnetic plate 12 is sandwiched between the first inner yoke 11 and the second inner yoke 13. Note that at this time, the magnetic plate 12 is in a demagnetized state. Next, as shown in FIG. 16, the first inner yoke 11 and the second inner yoke 13 which are in the state of sandwiching the magnetic plate 12 are subjected to positioning by the first positioning member 16*a* and the second positioning member 16*b*. Specifically, the positioning protrusion 111 of the first inner yoke 11 is subjected to positioning by the inner face 162*aa* of the first horizontal spacer unit 162*a* and the first positioning face 164*aa* of the vertical spacer unit 164*a* (see FIG. 6A), in the state of being sandwiched between the first horizontal spacer unit 162*a* and the protruding portion 165*a* of the vertical spacer unit 164*a* of the first positioning member 16*a*, and the positioning protrusion 112 of the first inner yoke 11 is subjected to positioning by the inner face 163*aa* of the second horizontal spacer unit 163*a* and the second positioning face 164*ab* of the vertical spacer unit 164*a* (see FIG. 6A), in the state of being sandwiched between the second horizontal spacer unit 163*a* and the protruding portion 166*a* of the vertical spacer unit 164*a* of the first positioning member 16*a*. Also, the positioning protrusion 113 of the first inner yoke 11 is subjected to positioning by the inner face 163*ba* of the second horizontal spacer unit 163*b* and the second positioning face 164*bb* of the vertical spacer unit 164*b* (see FIG. 6B), in the state of being sandwiched between the second horizontal spacer unit 163*b* and the protruding portion 166*b* of the vertical spacer unit 164*b* of the second positioning member 16*b*, and the positioning protrusion 114 of the first inner yoke 11 is subjected to positioning by the inner face 162*ba* of the first horizontal spacer unit 162*b* and the first positioning face 164*ba* of the vertical spacer unit 164*b* (see FIG. 6B), in the state of being sandwiched between the first spacer unit 162*b* and the protruding portion 165*b* of the vertical spacer unit 164*b* of the second positioning member 16*b*.

Further, although not clearly shown in FIG. 16, the second inner yoke 13 is also subjected to positioning by the first positioning member 16*a* and the second positioning member 16*b*, similar to the first inner yoke 11. That is to say, the positioning protrusion 131 of the second inner yoke 13 is subjected to positioning by the inner face 162*aa* of the first horizontal spacer unit 162*a* and the lower face of the vertical spacer unit 164*a* in the first positioning member 16*a* (see FIG. 6A), and the positioning protrusion 132 of the second inner yoke 13 is subjected to positioning by the inner face 163*aa* of the second horizontal spacer unit 163*a* and the lower face of the vertical spacer unit 164*b* in the first positioning member 16*a* (see FIG. 6A). Also, the positioning protrusion 133 of the second inner yoke 13 is subjected to positioning by the inner face 163*ba* of the second horizontal spacer unit 163*b* and the lower face of the vertical spacer unit 164*b* in the second positioning member 16*b*, and the positioning protrusion 134 of the second inner yoke 13 is subjected to positioning by the inner face 162*ba* of the first horizontal spacer unit 162*b* and the lower face of the vertical spacer unit 164 in the second positioning member 16*b*.

Thus, the first inner yoke 11 and the second inner yoke 13 having sandwiched the magnetic plate 12 are subjected to positioning in the horizontal direction by the first positioning member 16*a* and the second positioning member 16*b*, and the spacing between the first inner yoke 11 and the second inner yoke 13 is maintained at a thickness of the vertical spacer units 164*a* and 164*b* (corresponding to the thickness of the magnetic plate 12).

Figure 17:
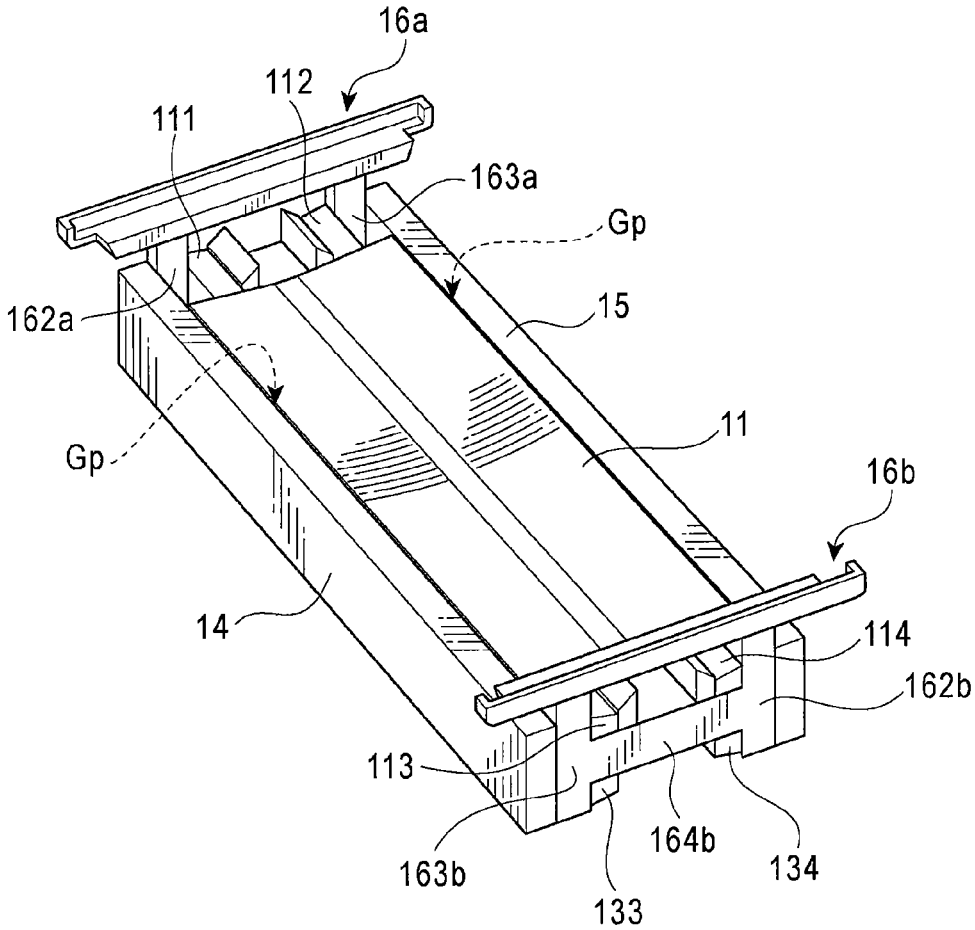
FIG. 17 is a perspective diagram illustrating a new configuration unit in a state wherein the first outer yoke and second outer yoke are further set in the first positioning member and second positioning member of the configuration unit shown in FIG. 16.

In such a state, as shown in FIG. 17, the first outer yoke 14 is positioned against the first horizontal spacer unit 162*a* of the first positioning member 16*a* and the second horizontal spacer unit 163*b* of the second positioning member 16*b*, and the second outer yoke 15 is positioned against the second horizontal spacer unit 163*a* of the first positioning member 16*a* and the first horizontal spacer unit 162*b* of the second positioning member. Thus, the space between each of the positioning protrusions 111, 113, 131, and 133 of the first inner yoke 11 and the second inner yoke 13 and the plate face of the first outer yoke 14 is held at a spacing equivalent to the width of the first horizontal spacer unit 162*a* of the first positioning member 16*a* and the second horizontal spacer unit 163*b* of the second positioning member 16*b*, and the space between each of the positioning protrusions 112, 114, 132, and 134 of the first inner yoke 11 and the second inner yoke 13 and the plate face of the second outer yoke 15 is held at a spacing equivalent to the width of the second horizontal spacer unit 163*a* of the first positioning member 16*a* and the first horizontal spacer unit 162*b* of the second positioning member 16*b*. Consequently, as shown in the details of FIG. 2 as well as FIG. 17, a magnetic gap Gp is formed between the plate face of the first outer yoke 14 and one of the side end faces of each of the first inner yoke 11 and the second inner yoke 13, and a magnetic gap Gp is formed between the plate face of the second outer yoke 15 and the other side end face of each of the first inner yoke 11 and the second inner yoke 13.

Figure 18:
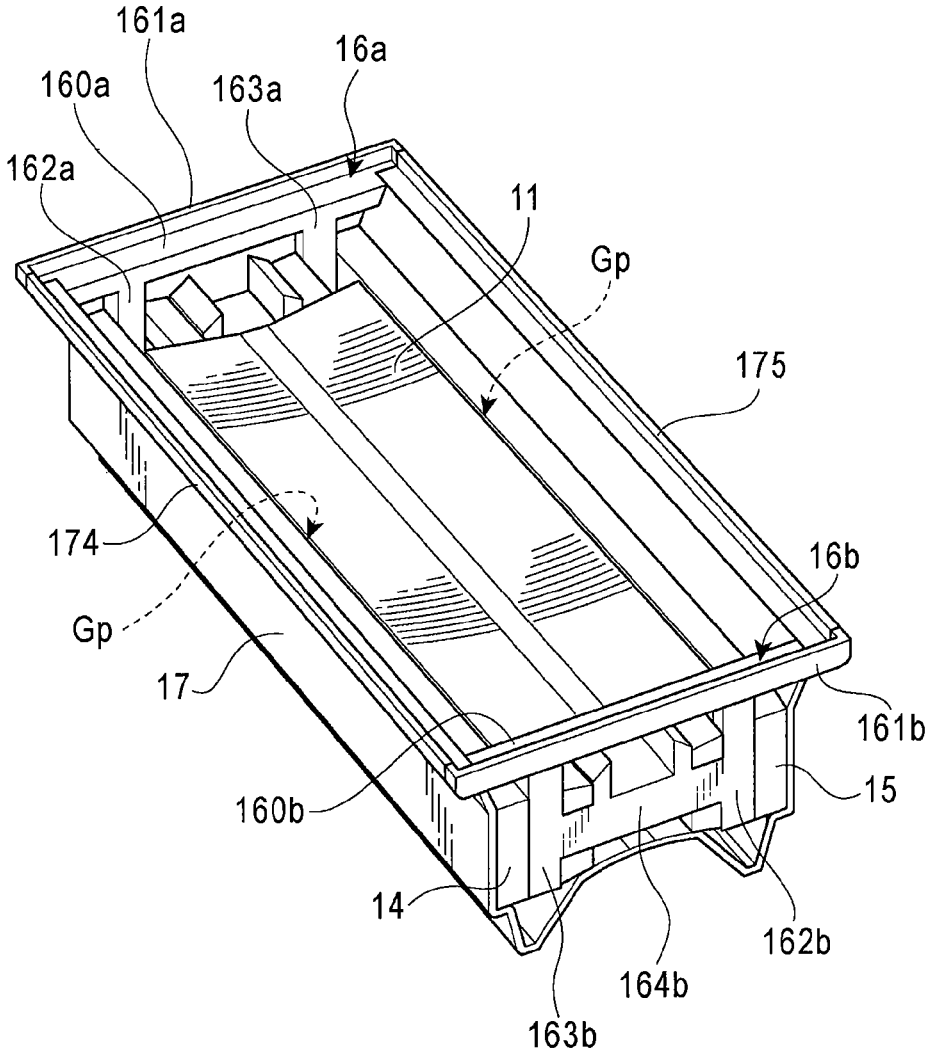
FIG. 18 is a perspective diagram showing a new configuration unit formed by attaching the frame member to the configuration unit shown in FIG. 17.

Next, the first inner yoke 11 and the second inner yoke 13 subjected to positioning by the first positioning member 16*a* and the second positioning member 16*b* in the state of sandwiching the magnetic plate 12, and the first outer yoke 14 and the second outer yoke 15, are contained within the frame member 17, as shown in detail in FIG. 2 as well as FIG. 18. The floor portion 171 of the frame member 17 presses the second inner yoke 13 against the vertical spacer units 164*a* and 164*b* of the first positioning member 16*a* and the second positioning member 16*b*, and the first pressing unit 172 and the second pressing unit 173 of the frame member 17 sandwiches the first outer yoke 14 and the second outer yoke 15, whereby the first outer yoke 14 is pressed by the first horizontal spacer unit 162*a* of the first positioning member 16*a* and the second horizontal spacer unit 163*b* of the second position determining unit 16*b*, and the second outer yoke 15 is pressed by the second horizontal spacer unit 163*a* of the first positioning member 16*a* and the first spacer unit 162*b* of the second positioning member 16*b*. Thus, magnetic plate 12, first inner yoke 11, second inner yoke 13, first outer yoke 14, and second outer yoke 15 which make up the magnetic circuit are integrated along with the first positioning member 16*a* and the second positioning member 16*b*.

Both ends of the first outer edge portion 174 of the frame member 17 engage with one end of the outer frame unit 161*a* of the first positioning member 16*a* and one end of the outer frame unit 161*b* of the second positioning member 16*b*, and both ends of the second outer edge portion 175 of the frame member 17 engage with the other end of the outer frame unit 161*a* of the first positioning member 16*a* and the other end of the outer frame unit 161*b* of the second positioning member 16*b*. Thus, the magnetic circuit made up of the magnetic plate 12, the first inner yoke 11, the second inner yoke 13, the first outer yoke 14, and the second outer yoke 15 is surrounded by a frame unit that is made up of the first outer edge portion 174 and the second outer edge portion 175 of the frame member 17, the outer frame unit 161*a* of the first positioning member 16*a*, and the outer frame unit 161*b* of the second positioning member 16*b*.

Figure 19:
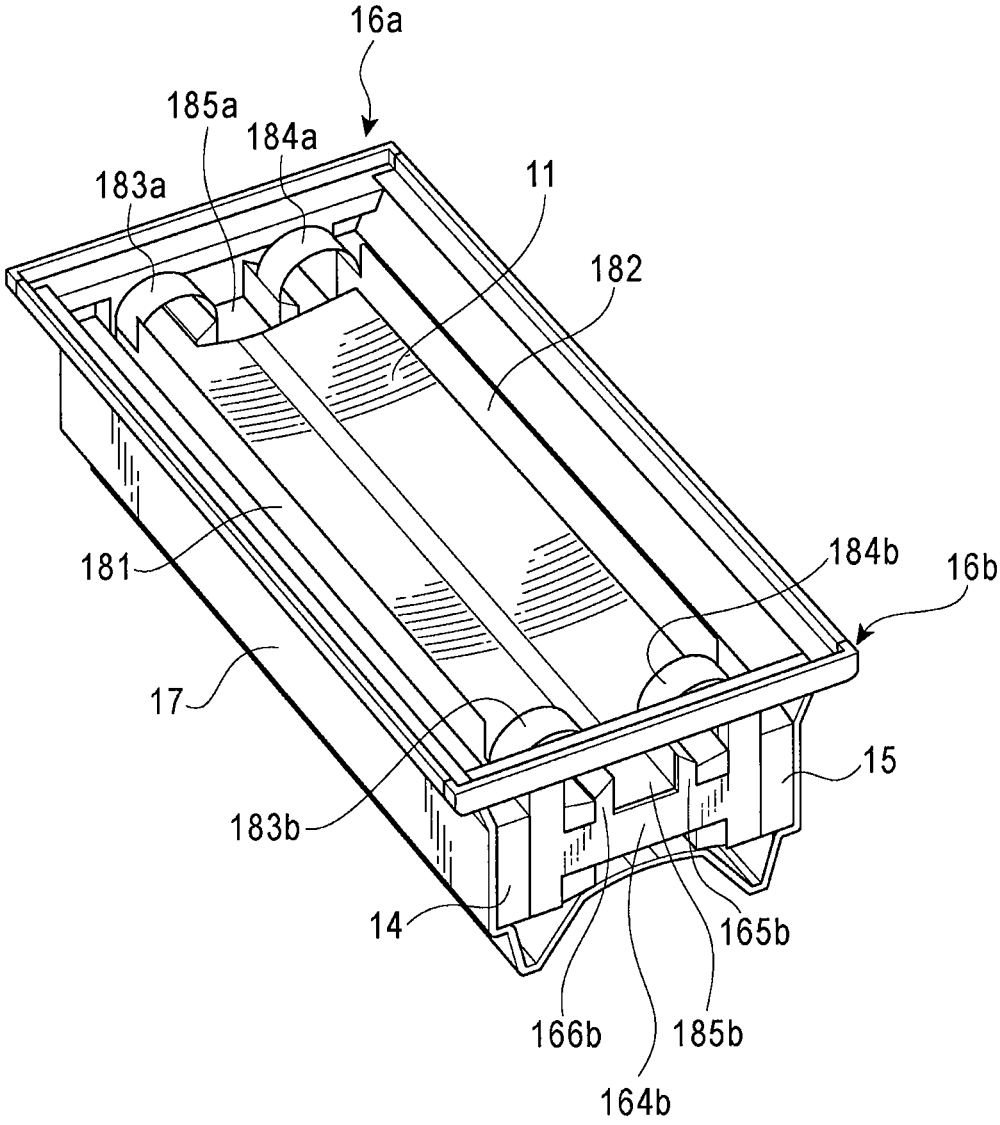
FIG. 19 is a perspective diagram showing a new configuration unit formed by attaching the voice coil unit to the configuration unit shown in FIG. 18.

Next, as shown in FIG. 19, the voice coil unit 18 is set with respect to the above-described magnetic circuit (see FIG. 9). Specifically, a first voice coil portion 181 of the voice coil unit 18 is disposed within a magnetic gap Gp which is formed between one of the side end faces of each of the first inner yoke 11 and the second inner yoke 13 and the plate face of the first outer yoke 14, and a second voice coil portion 182 is disposed within a magnetic gap Gp which is formed between the other side end faces of each of the first inner yoke 11 and the second inner yoke 13 and the plate face of the second outer yoke 15 (see FIG. 2). A first terminal unit 185*a* is fixed to a terminal set face 167*a* between the two protruding portions 165*a* and 166*a* of the vertical spacer unit 164*a* (see FIG. 6A) in the first positioning member 16*a*, and a second terminal unit 185*b* is fixed to a terminal set face 167*b* between the two protruding portions 165*b* and 166*b* of the vertical spacer unit 164*b* (see FIG. 6B) in the second positioning member 16*b*. In this state, the first voice coil portion 181 disposed within the magnetic gap Gp that is formed between one of the side end faces of each of the first inner yoke 11 and the second inner yoke 13 and the plate face of the first outer yoke 14 has both end portions elastically supported by the first-first supporting unit 183*a* following from the first terminal unit 185*a* and the second-first supporting unit 183*b* following from the second terminal unit 185*b*, and can vibrate vertically within the magnetic gap Gp. Also, the second voice coil portion 182 disposed within the magnetic gap Gp that is formed between the other side end faces of each of the first inner yoke 11 and the second inner yoke 13 and the plate face of the second outer yoke 15 has both end portions elastically supported by the first-second supporting unit 184*a* following from the first terminal unit 185*a* and the second-second supporting unit 184*b* following from the second terminal unit 185*b*, and can vibrate vertically within the magnetic gap Gp.

Note that as shown in FIG. 2, the line pattern L11 of a first voice coil line pattern 186 (188) formed in the first voice coil portion 181 is arrayed between one of the side end faces of the first inner yoke 11 and the plate face of the first outer yoke 14, and the line pattern L12 of the first voice coil line pattern 186 (188) is arrayed between one of the other side end faces of the second inner yoke 13 and the plate face of the first outer yoke 14. Also, the line pattern L21 of a second voice coil line pattern 187 (189) formed in the second voice coil portion 182 is arrayed between the other side end face of the first inner yoke 11 and the plate face of the second outer yoke 15, and the line pattern L22 of the second voice coil line pattern 187 (189) is arrayed between the other side end face of the second inner yoke 13 and the plate face of the second outer yoke 15.

Figure 20:
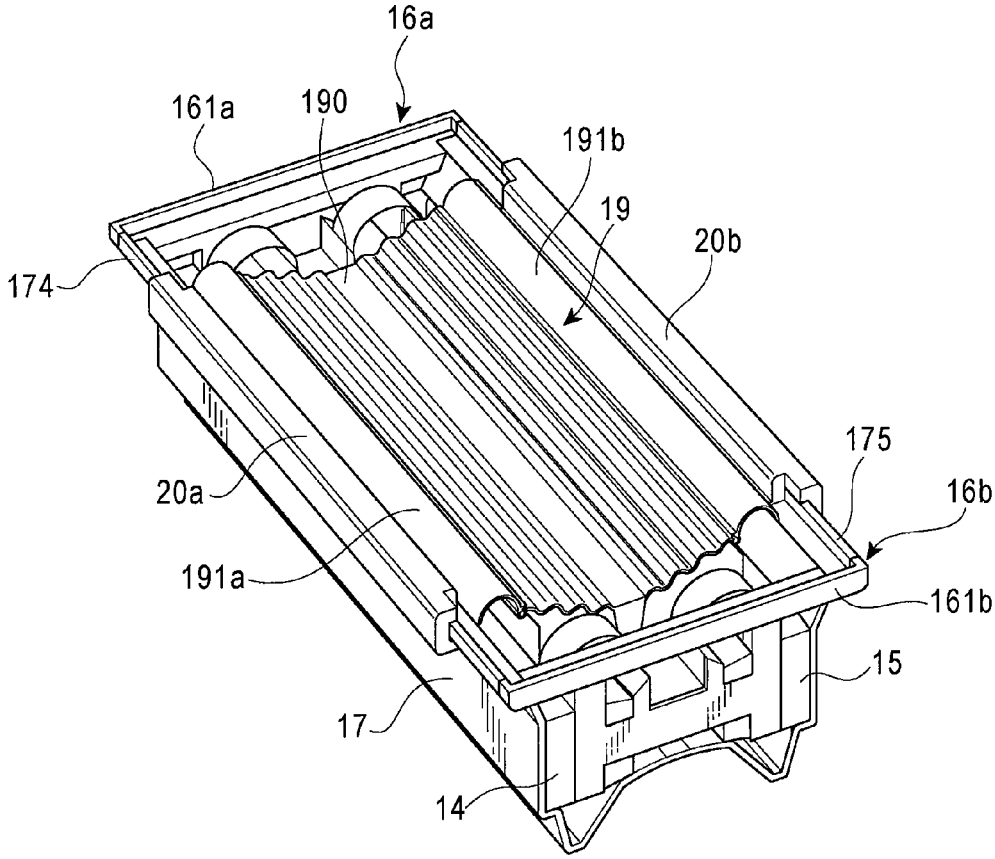
FIG. 20 is a perspective diagram illustrating a new configuration unit formed by attaching the damper member to the configuration unit shown in FIG. 19.

Next, as shown in FIG. 20, a damper member 19 is attached. A first vertical edge portion 20*a* following a first supporting unit 191*a* that is formed on one of the outer edge portions of the damper member 19 is fixed to the first outer edge portion 174 of the frame member 17, and a second vertical edge portion 20*b* following a second supporting unit 191*b* that is formed on the other outer edge portion of the damper member 19 is fixed to the second outer edge portion 175 of the frame member 17 (see FIG. 2). Thus, the damper member 19 is provided between the first outer edge portion 174 and the second outer edge portion 175 of the frame member 17 so as to cover the magnetic circuit and voice coil unit 18.

Figure 21:
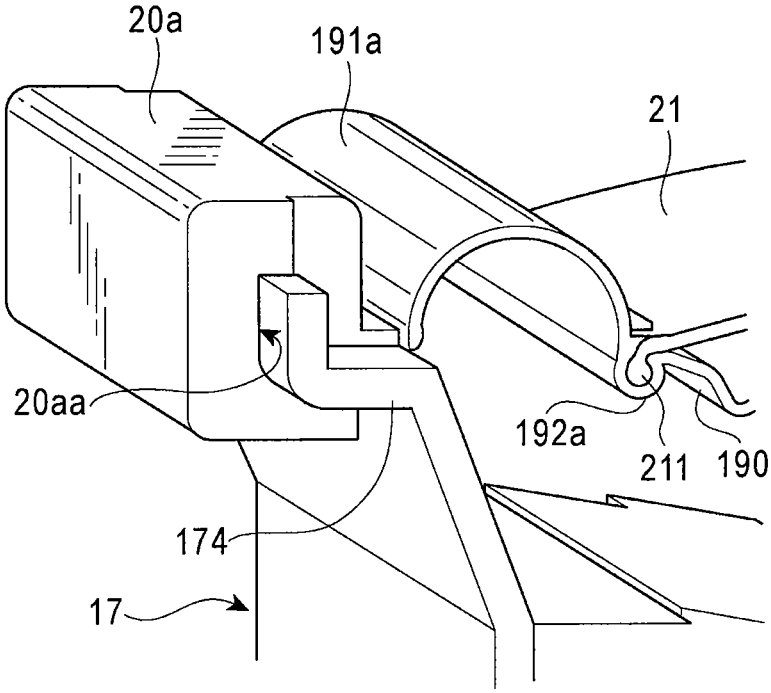
FIG. 21 is a partial expanded perspective diagram illustrating a fixed configuration of a first vertical edge unit (second vertical edge unit) and frame member in the configuration unit shown in FIG. 20.

Fixing the damper member 19 to the frame member 17 is performed, specifically, by sliding to fit the first fitting groove 20*aa* of the first vertical edge unit 20*a* onto the first outer edge portion 174 of the frame member 17, and similarly sliding to fit the second fitting groove 20*ba* of the second vertical edge unit 20*b* onto the second outer edge portion 175 on the opposite side of the frame member 17, as shown expanded in FIG. 21.

When that the damper member 19 is attached, the leading edge portion of the first voice coil portion 181 extending from the magnetic gap Gp is fixed to the border portion between the damper main unit 190 and the first supporting unit 191*a* (the portion forming the first fitting groove 192*a*) with an adhesive, as shown in FIG. 2. Also, the leading edge portion of the second voice coil portion 182 extending from the magnetic gap Gp is fixed to the border portion between the damper main unit 190 and the second supporting unit 191*b* (the portion forming the second fitting groove 192*b*) with an adhesive. Thus, the entire voice coil unit 18 is elastically supported by the damper member 19.

Figure 22:
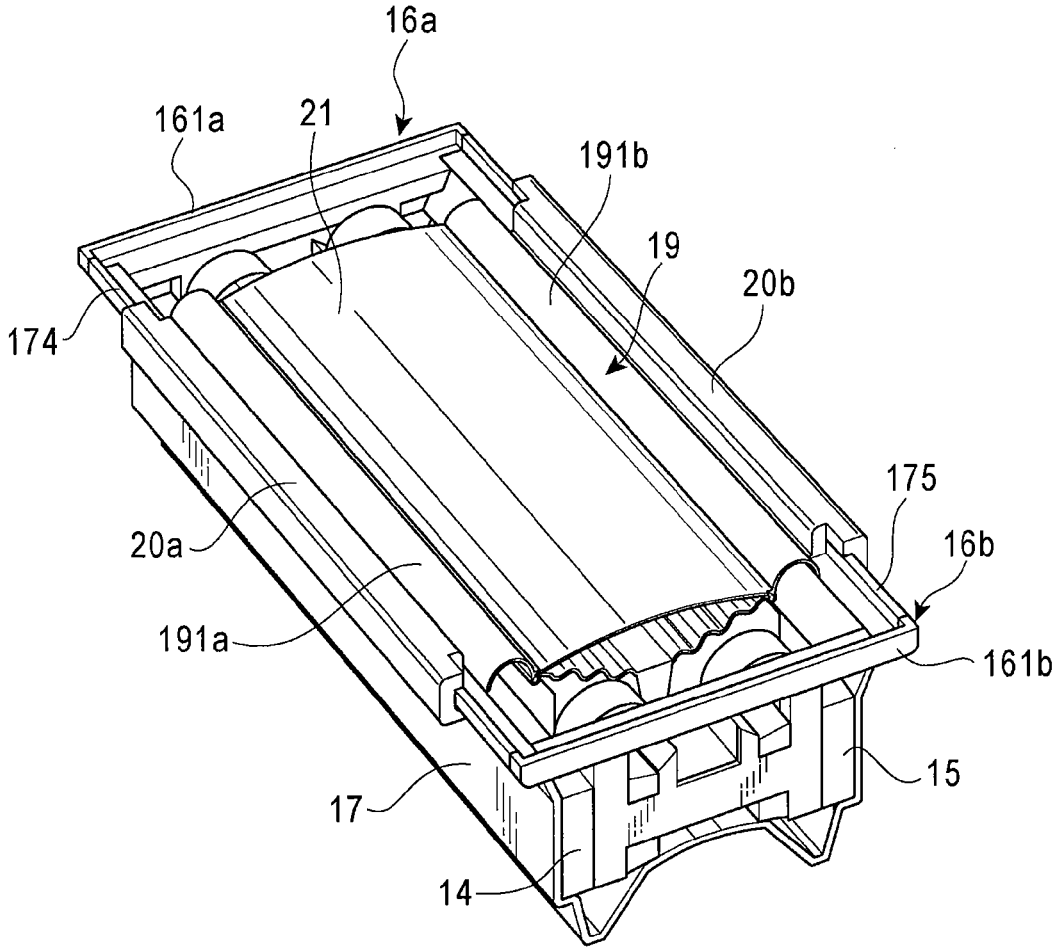
FIG. 22 is a perspective diagram illustrating a new configuration unit formed by attaching a diaphragm to the configuration unit shown in FIG. 20.
Figure 23:
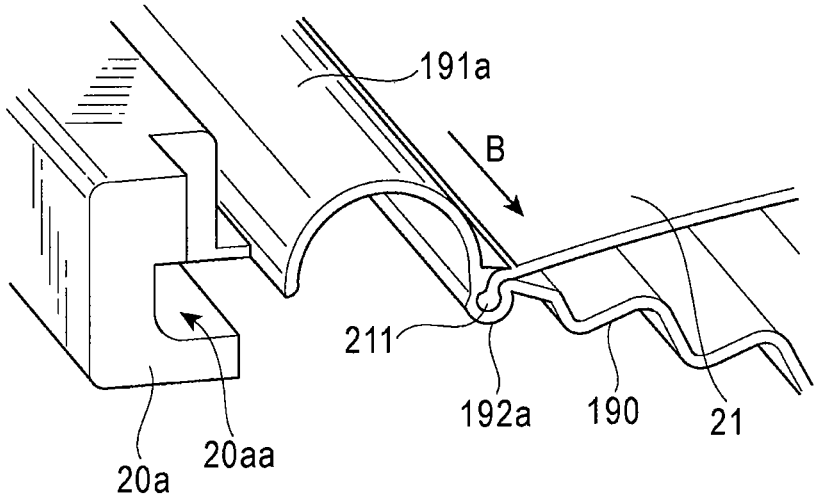
FIG. 23 is a partial expanded perspective diagram illustrating a fixed configuration of a damper member and diaphragm of a configuration unit shown in FIG. 22.

Next, as shown in FIG. 22, the diaphragm 21 is attached to the damper member 19. Specifically, as shown expanded in FIG. 23 as well as in FIG. 21, a first sliding unit 211 of the diaphragm 21 is slid to fit into the first fitting groove 192*a* formed in the border portion between the damper main unit 190 and the first supporting unit 191*a*. Also, a second sliding unit 212 of the diaphragm 21 is similarly slid to fit into the second fitting groove 192*b* formed in the border portion between the damper main unit 190 and the second supporting unit 191*b*. Thus, the diaphragm 21 is fixed to the damper member 19 (damper main unit 190). Also, as described above, the leading end portion of the first voice coil portion 181 of the voice coil unit 18 is adhered to the border portion between the damper main unit 190 and the first supporting unit 191*a* with an adhesive, and also, the leading end portion of the second voice coil portion 182 of the voice coil unit 18 is adhered to the border portion between the damper main unit 190 and the second supporting unit 191*b* with an adhesive agent (see FIG. 2), whereby the voice coil unit 18 (first voice coil portion 181, second voice coil portion 182) are constructed to link to the diaphragm 21, and the vibrations of the voice coil unit 18 transmit to the diaphragm 21.

Lastly, as shown in FIG. 1, the first horizontal edge portion 22*a* and the second horizontal edge portion 22*b* are attached, and the assembly of the various parts is ended. Specifically, as shown in FIG. 22, the outer frame portions 161*a* and 161*b* of the first positioning member 16*a* and the second positioning member 16*b* and the first outer edge unit 174 and the second outer edge unit 175 of the frame member 17 are linked to form a rectangular-shaped frame. The edge engaging portion 221*a* of the first horizontal edge unit 22*a* is fixed to the end portion on the outer frame unit 161*a* side of the first positioning member 16*a* of this frame, and the edge engaging portion 221*b* of the second horizontal edge unit 22*b* is fixed to the end portion on the outer frame unit 161*b* side of the second positioning member 16*b* of the frame. Thus, the edge engaging portions 221*a* and 222*a* are linked to the first vertical edge portion 20*a* and the second vertical edge portion 20*b*, and the edge cover units 222*a* and 222*b* link to the diaphragm 21 and the end edge of the damper member 19 (first supporting unit 191*a* and second supporting unit 191*b*).

When the various parts are thus assembled, the magnetic plate is magnetized. When the magnetic plate 12 is magnetized, the first inner yoke 11, the second inner yoke 13, the first outer yoke 14, and the second outer yoke 15 are drawn to the magnetic plate 12, and these are strongly integrated along with the first positioning member 16*a* and the second positioning member 16*b*. However, it should be noted that the magnetic gap Gp between one of the side end faces of each of the first inner yoke 11 and the second inner yoke 13 and the plate face of the first outer yoke 14, and the magnetic gap Gp between the other side end faces of each of the first inner yoke 11 and the second inner yoke 13 and the plate face of the second outer yoke 15 are accurately maintained, by the first positioning member 16*a* and the second positioning member 16*b*.

Note that the parts that are assembled as described above may be adhesively fixed with an adhesive agent as needed before the magnetic plate 12 is magnetized.

Figure 24A:
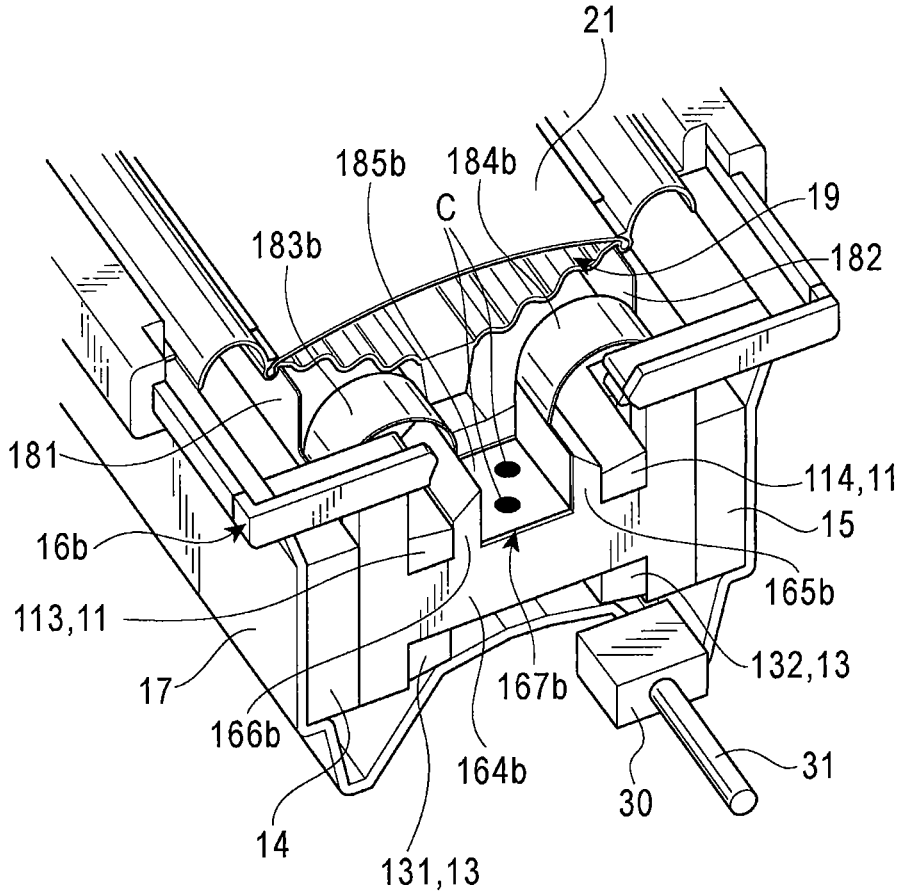
FIG. 24A is a perspective diagram illustrating an expansion of a state wherein a second terminal unit of the voice coil unit is set in a terminal set face of a second positioning member.
Figure 24B:
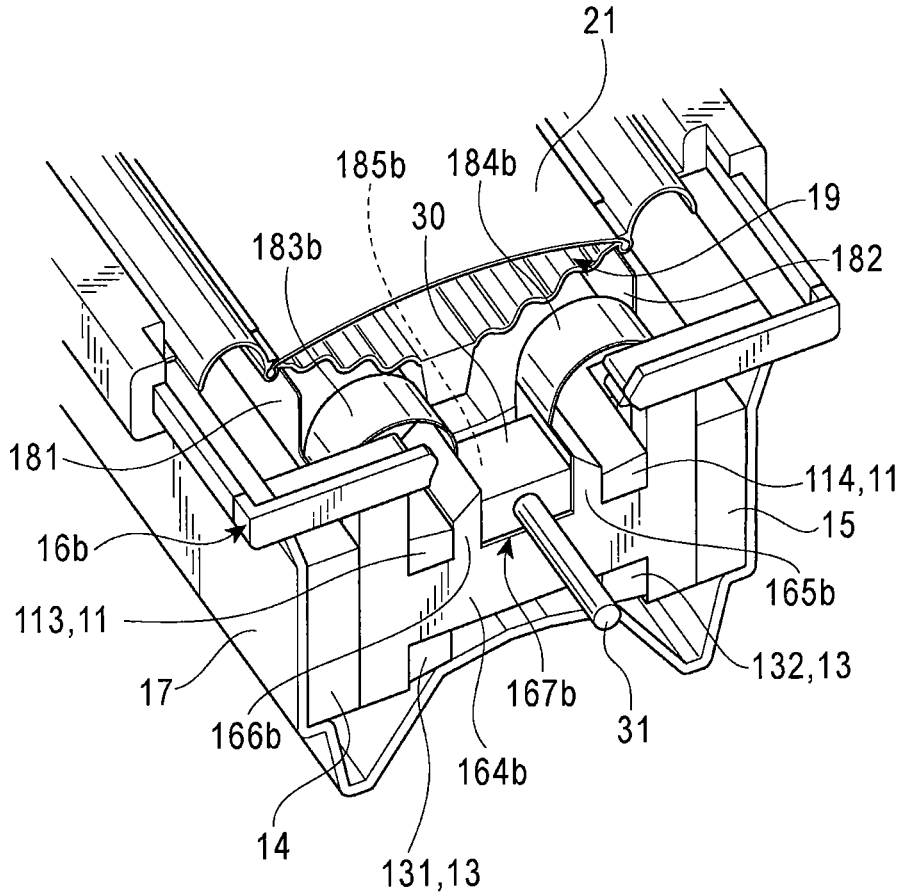
FIG. 24B is a perspective diagram illustrating an expansion of a fixed configuration of the second terminal unit of the voice coil unit that has been set in the terminal set face of the second positioning member.

The electrical connection with the audio signal output circuit of the voice coil unit 18 is as shown in FIGS. 24A and 24B. Note that FIGS. 24A and 24B show an expanded view of the configuration of the second terminal unit 185*b* of the voice coil unit 18, but the first terminal unit 185*a* of the voice coil unit 18 has the same configuration. Note that in this case, a voice coil line pattern (first voice coil line pattern 188, second voice coil line pattern 189) such as shown in FIG. 13B, for example, is formed in the first voice coil portion 181 and the second voice coil portion 182 of the voice coil unit 18.

In FIG. 24A, in the U-shape formed by the two protruding portions 165*b* and 166*b* and the terminal set face 167*b* of the vertical spacer unit 164*b* of the second positioning member 16*b*, a second terminal unit 185*b* is set in the border portion between the second-first supporting unit 183*b* following the first voice coil portion 181 and the second-second supporting portion 184*b* following the second voice coil portion 182. A pair of connecting points C of the second voice coil line pattern 189 are formed on the second terminal unit 185*b* so as to be exposed. A coupler terminal 30 is connected to the leading edge of a lead line 31 extending from the audio signal output circuit. The coupler terminal 30 is made of resin, and has an exterior shape that matches the U-shaped second terminal unit 185*b* of the voice coil unit 18. As shown in FIG. 24B, when the coupler terminal 30 is inserted into the second terminal unit 185*b* that is a U-shape formed with the two protruding portions 165*b* and 166*b* and the terminal set face 167*b* of the vertical spacer unit 164*b* of the second positioning member 16*b*, a connecting point (not shown) that becomes a pair following the lead line 31 of the coupler terminal 30 is pressed to make contact with the connecting points C of the second terminal unit 185*b*. Thus, the lead line 31 and the second voice coil line pattern 189 are electrically connected, and the audio signal supplied from the audio signal output circuit through the lead line 31 is supplied to the second voice coil line pattern 189 via the connecting points C of the second terminal unit 185*b*.

As described above, although the first terminal unit 185*a* on the opposite side from the second terminal unit 185*b* of the voice coil unit 18 is not shown in FIGS. 24A and 24B, similar to the case of the second terminal unit 185*b*, a coupler terminal connected to the lead line is also inserted into the first terminal unit 185*a* that is a U-shape formed with two protruding portions 165*a* and 166*a* and the terminal set face 167*a* of the vertical spacer unit 164*a* of the first positioning member 16*a*. Thus, the audio signal supplied from the audio signal output circuit through the lead line 31 is supplied to the first voice coil line pattern 188 formed on the first voice coil portion 181 via the connecting points C of the first terminal unit 185*a*.

The same audio signal can be supplied in parallel to the first voice coil line pattern 188 formed in the first voice coil portion 181 and the second voice coil line pattern 189 formed in the second voice coil portion 182. Also, audio signals of frequency features (e.g., for higher sounds and for lower sounds) that differ for the first voice coil line pattern 188 and the second voice coil line pattern 189 can be supplied. Further, audio signals (e.g., vocal audio and instrumental audio) that differ for the first voice coil line pattern 188 and the second voice coil line pattern 189 can be supplied.

Note that even in a case that a voice coil line pattern (first voice coil line pattern 186, second voice coil line pattern 187) such as shown in FIG. 13A, for example, is formed in the first voice coil portion 181 and the second voice coil portion 182 of the voice coil unit 18, by fitting a similar coupler terminal into the first terminal unit 185*a* or the second terminal unit 185*b* of the voice coil unit 18, audio signals can be supplied to the first voice coil line pattern 186 and the second voice coil line pattern 187 via the two pairs of connecting points. Note that a dummy coupler terminal can be inserted into a first terminal unit 185*a* or a second terminal unit 185*b* to which audio signals are not supplied.

Figure 25:
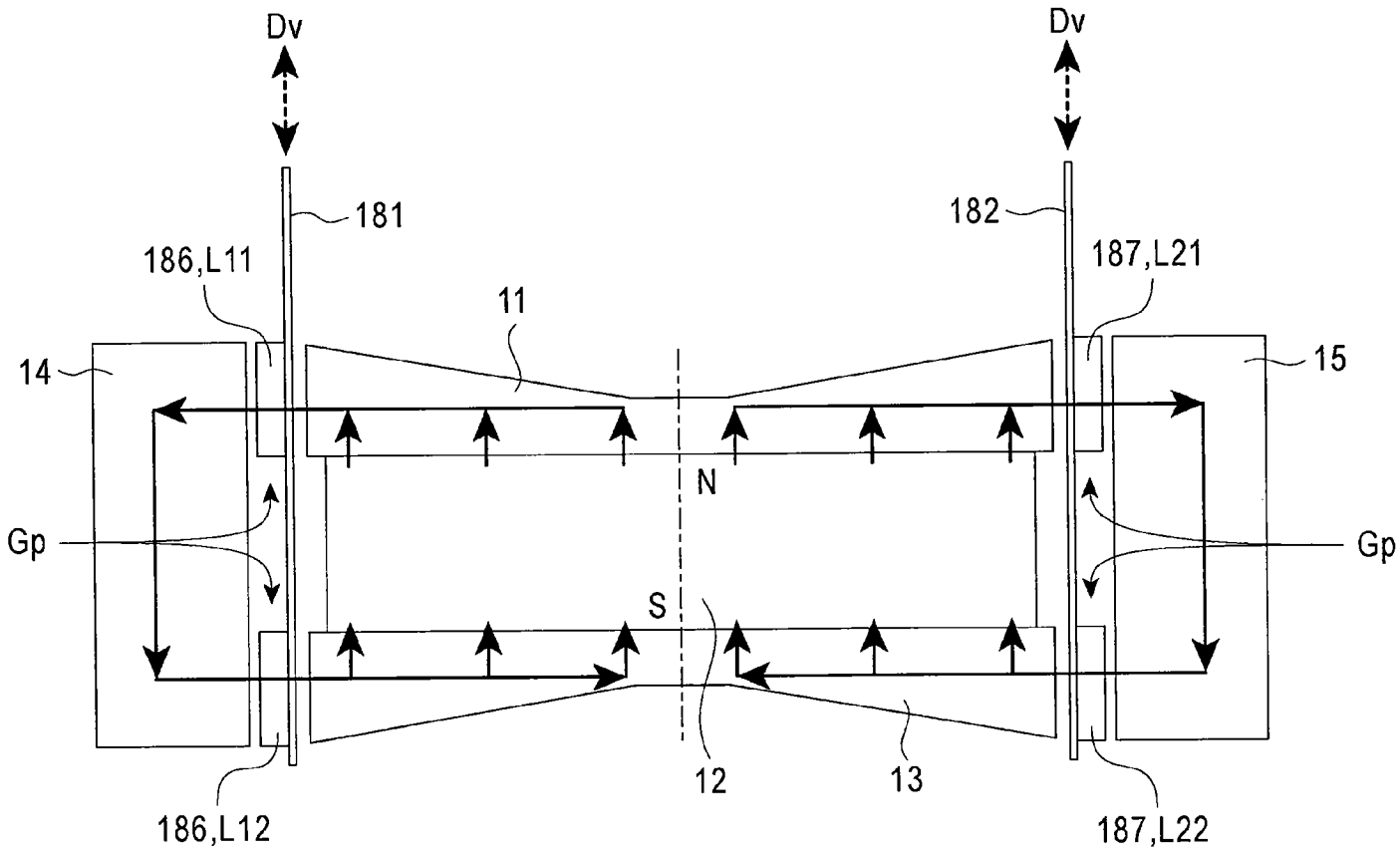
FIG. 25 is a diagram showing a magnetic flux within a magnetic circuit in a speaker device of the configuration shown in FIG. 2.

A magnetic flux is generated as shown in FIG. 25, in the magnetic circuit (magnetic plate 12, first inner yoke 11, second inner yoke 13, first outer yoke 14, and second outer yoke 15). In FIG. 25, the magnetic flux from the North pole side of the magnetic plate 12 travels from one side face of the first inner yoke 11, cuts across the magnetic gap Gp, arrives at the first outer yoke 14, and the magnetic flux having passed through the first outer yoke 14 travels from the first outer yoke 14, cuts across the magnetic gap Gp, arrives at one side end face of the second inner yoke 13, and returns to the South pole side of the magnetic plate 12. Also, the magnetic flux from the North pole side of the magnetic plate 12 travels from the other side end face of the first inner yoke 11, cuts across the magnetic gap Gp, arrives at the second outer yoke 15, and the magnetic flux having passed through the second outer yoke 15 travels from the second outer yoke 15, cuts across the magnetic gap Gp, arrives at the other side end face of the second inner yoke 13, and returns to the South pole side of the magnetic plate 12.

An audio signal is supplied to the first voice coil line pattern 186 (L11, L12) and the second voice coil line pattern 187 (L21, L22) of the voice coil unit 18 via the coupler terminal 30 in the state that the magnetic flux is formed in the magnetic circuit, as shown in FIG. 25. In FIG. 25, the magnetic flux that cuts across the magnetic gap Gp formed between one of the side end faces of the first inner yoke 11 and the plate face of the first outer yoke 14, and the magnetic flux that cuts across the magnetic gap Gp formed between one of the side end faces of the second inner yoke 13 and the plate face of the first outer yoke 14, go in opposite directions, but the direction of the audio current flowing between the line pattern L11 and the line pattern L12 of the first voice coil line pattern 186 arrayed within each magnetic gap Gp also goes in the opposite direction, whereby force acts in the same direction as the line pattern L11 and the line pattern L12 by mutual action of the magnetic flux within the magnetic gap Gp and the audio signal current, and the first voice coil portion 181 formed in the first voice coil line pattern 186 vibrates in the vertical direction Dv according to the audio signal.

Also, in FIG. 25, the magnetic flux that cuts across the magnetic gap Gp formed between the other side end face of the first inner yoke 11 and the plate face of the second outer yoke 15, and the magnetic flux that cuts across the magnetic gap Gp formed between the other side end face of the second inner yoke 13 and the plate face of the second outer yoke 15, similarly go in opposite directions. In this case also, the direction of the audio current flowing between the line pattern L21 and the line pattern L22 of the second voice coil line pattern 187 arrayed within each magnetic gap Gp also goes in the opposite direction, whereby force acts in the same direction as the line pattern L21 and line pattern L22 by mutual action of the magnetic flux within the magnetic gap Gp and the audio signal current, and the second voice coil portion 182 formed in the second voice coil line pattern 187 vibrates in the vertical direction Dv according to the audio signal.

With the vertical direction Dv vibrations of the first voice coil portion 181 and the second voice coil portion 182 according to the audio signal, the diaphragm 21 which is linked to the voice coil portions 181 and 182 vibrates according to the audio signal. Consequently, sound corresponding to the audio signal is output.

With a speaker device 10 according to the first embodiment as described above, the magnetic circuit is in a state wherein the positions of the first inner yoke 11, the second inner yoke 13, the first outer yoke 14, and the second outer yoke 15 are determined by the first positioning member 16*a* and the second positioning member 16*b* so that the magnetic gap Gp is formed, whereby the magnetic plate 12, the first inner yoke 11, the second inner yoke 13, the first outer yoke 14, and the second outer yoke 15 have an integrated configuration, and so the magnetic circuit can be assembled in a workable manner by the first positioning member 16*a* and the second positioning member 16*b*. Further, other parts, specifically the frame member 17, the voice coil unit 18, and the first horizontal edge unit 22*a* and the second horizontal edge unit 22*b* are also attached to the first positioning member 16*a* and the second positioning member 16*b*, whereby the assembly workability is further improved.

Also, the positions of the first inner yoke 11, the second inner yoke 13, the first outer yoke 14, and the second outer yoke 15 are determined by the first positioning member 16*a* and the second positioning member 16*b*, whereby even if the position fixing force by adhesive agent of the first inner yoke 11, the second inner yoke 13, the first outer yoke 14, and the second outer yoke 15 is reduced, position shifting can be prevented. As a result, separation of the magnetic circuit (magnetic plate 12, first inner yoke 11, second inner yoke 13, first outer yoke 14, and second outer yoke 15) becomes easy, whereby recycling individual parts of the magnetic circuit becomes relatively easy.

Also, electrical connection with the audio signal output circuit of the voice coil unit 18 is made by the coupler terminal 30 which is fitted into the first terminal unit 185*a* and the second terminal unit 185*b* of the voice coil unit 18 (see FIGS. 24A and 24B), whereby pulling the lead line as to the voice coil unit 18 becomes simple, and the assembly becomes easy. Also, the voice coil unit 18 can be prevented from being subjected to unnecessary load such as being pulled by the lead line.

Next, a speaker device according to a second embodiment of the present invention will be described. With the speaker device 10 according to the first embodiment of the present invention as described above, two pairs of magnetic gaps Gp are formed in the magnetic circuit (magnetic plate 12, first inner yoke 11, second inner yoke 13, first outer yoke 14, and second outer yoke 15), but the speaker device according to the second embodiment of the present invention has a configuration wherein one magnetic gap Gp is formed in the magnetic circuit.

Figure 26:
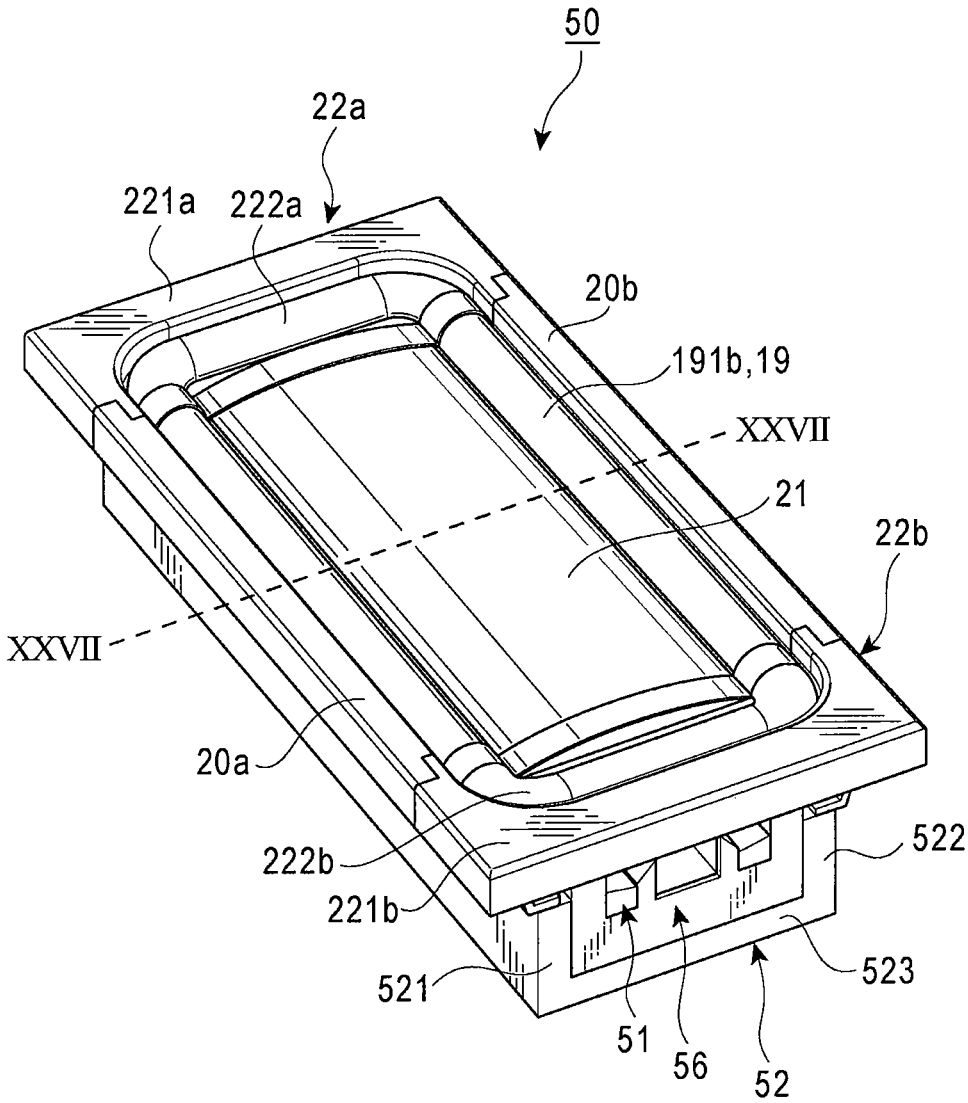
FIG. 26 is a perspective diagram showing an external view of the speaker device relating to a second embodiment of the present invention.

An external view of the speaker device according to the second embodiment of the present invention is shown in FIG. 26. A speaker device 50 shown in FIG. 26 is an angular shaped speaker device, similar to the speaker device 10 shown in FIG. 1, and is formed by assembling the various parts of a rectangular plate-shaped metallic inner yoke 51 shown in FIG. 28, an outer yoke 52 having a U-shaped cross-section shown in FIG. 29, a first positioning member 53*a* made of a non-magnetic body shown in FIG. 30A, a second positioning member 53*b* made of a non-magnetic body shown in FIG. 30B, a first frame member 54 and a second frame member 55 shown in FIG. 31, and a voice coil unit 56 shown in FIG. 32, as well as a magnetic plate 12 shown in FIG. 4, a damper member 19 shown in FIG. 10, a diaphragm 21 shown in FIG. 11, and a first horizontal edge unit 22*a* and a second horizontal edge unit 22*b* shown in FIG. 12, similar to the speaker device 10 according to the first embodiment.

Figure 28:
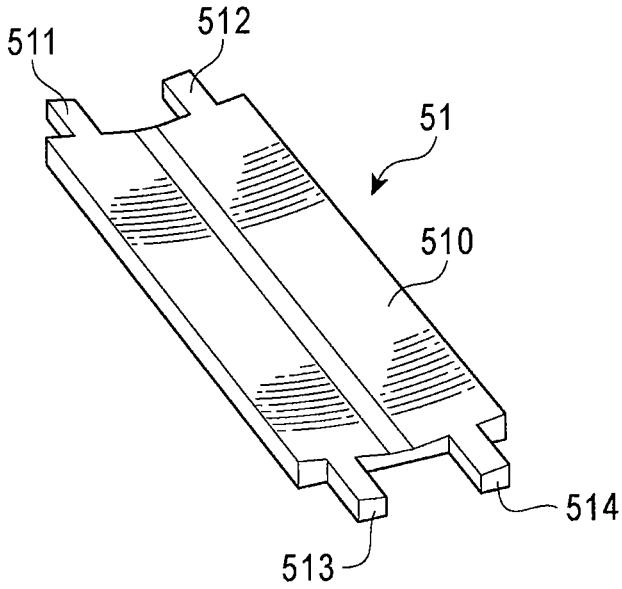
FIG. 28 is a perspective diagram illustrating a configuration of an inner yoke.
Figure 29:
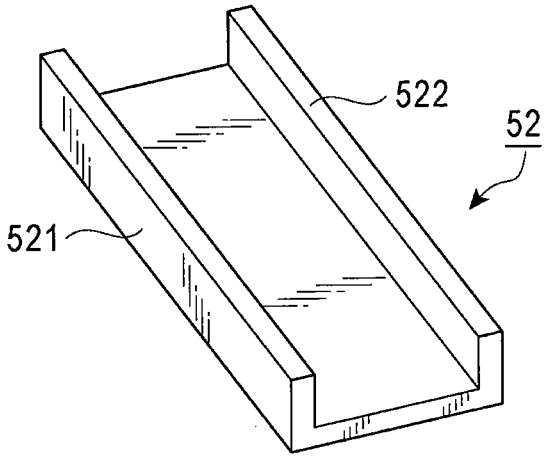
FIG. 29 is a perspective diagram illustrating a configuration of an outer yoke.

The inner yoke 51 shown in FIG. 28 has a configuration wherein positioning protrusions 511 and 512 and positioning protrusions 513 and 514 are formed as a pair on both end portions of the lengthwise direction of the rectangular plate-shaped yoke main unit 510, similar to the first inner yoke 11 shown in FIG. 3. The outer yoke 52 shown in FIG. 29 has a first outer yoke portion 521 and a second outer yoke portion 522 which are disposed so as to face one another at a predetermined spacing, and a linking unit 523 that links an end portion of the first outer yoke portion 521 and the second outer yoke portion 522, and has a configuration that is formed having a U-shaped cross-section.

Figure 30A:
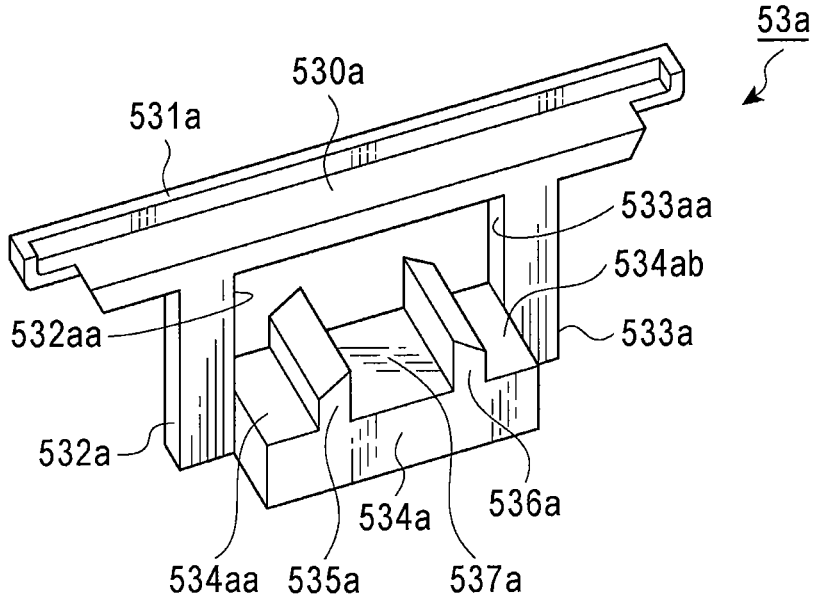
FIG. 30A is a perspective diagram illustrating a configuration of a first positioning member.
Figure 30B:
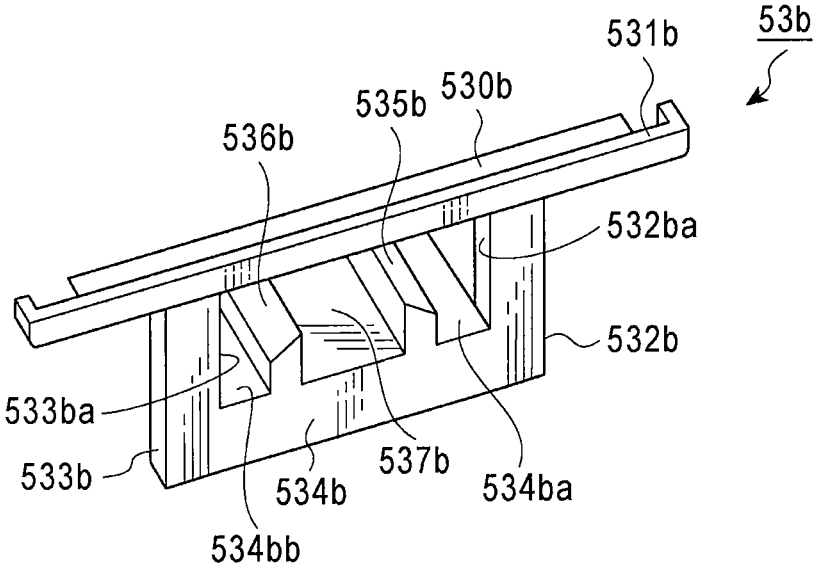
FIG. 30B is a perspective diagram illustrating a configuration of a second positioning member.

The first positioning member 53*a* shown in FIG. 30A and the second positioning member 53*b* shown in FIG. 30B are used to determine the positions of the inner yoke 51 and the outer yoke 52. The configuration of the first positioning member 53*a* will be described below, and the second positioning member 53*b* has the same configuration. In FIG. 30A (FIG. 30B), an angular-rod shaped first horizontal spacer unit 532*a* (532*b*) and a second horizontal spacer unit 533*a* (533*b*) are formed on a horizontal bar 530*a* (530*b*) so as to extend down therefrom. The spacing of the inner face 532*aa* (532*ba*) of the first horizontal spacer unit 532*a* (532*b*) and the inner face 533*aa* (533*ba*) of the second horizontal spacer unit 533*a* (533*b*) is set to the same distance as between the outer side faces of the protrusion pairs 511, 512 (513, 514) of the inner yoke 51. Also, the width in the horizontal direction for each of the first horizontal spacer unit 532*a* (532*b*) and the second horizontal spacer unit 533*a* (533*b*) is set to a value corresponding to spacing that the spacers should have. Note that the width herein is determined taking into account the horizontal width of the inner yoke 51 and the magnetic gap Gp that is to be formed.

A rectangular-shaped vertical spacer unit 534*a* (534*b*) is formed between the first horizontal spacer unit 532*a* (532*b*) and the second horizontal spacer unit 533*a* (533*b*), so as to connect the lower edge portion thereof in the vertical direction of the respective inner faces 532*aa* (532*ba*), 533*aa* (533*ba*) thereof. The thickness in the vertical direction of the vertical spacer unit 534*a* (534*b*) is set to a value that corresponds to the spacing that the spacer should have. Note that this thickness is determined taking into account the spacing that the inner yoke 51 and the linking unit 523 of the outer yoke 52 are to maintain, i.e. the thickness of the magnetic plate 12. Two protruding portions 535*a* (535*b*) and 536*a* (536*b*) are formed on the upper face of the vertical spacer unit 534*a* (534*b*), so as to extend in the direction orthogonal to the direction that the horizontal bar 530*a* (530*b*) is extended, and in the form whereby the upper outer edges are chamfered. The two protruding portions 535*a* (535*b*) and 536*a* (536*b*) are positioned symmetrically on the right and left of the center of the upper face of the vertical spacer unit 534*a* (534*b*), at a predetermined spacing. With the two protruding portions 535*a* (535*b*) and 536*a* (536*b*), the upper face of the vertical spacer unit 534*a* (534*b*) is divided into three portions. The portion between the two protruding portions 535*a* (535*b*) and 536*a* (536*b*) becomes a terminal set face 537*a* (537*b*) wherein the terminal unit of the voice coil unit 56 is set, as described later, the portion between one of the protruding portions 535*a* (535*b*) and the first horizontal spacer unit 532*a* (532*b*) becomes a first positioning face 534*aa* (534*ba*) for determining the position of the inner yoke 51, and further, the portion between the other protruding portion 536*a* (536*b*) and the second horizontal spacer unit 533*a* (533*b*) becomes a second positioning face 534*ab* (534*bb*) for determining the position of the inner yoke 51. The spacing between one of the protruding portions 535*a* (535*b*) and the first horizontal spacer unit 532*a* (532*b*) is set so as to correspond to the width of the positioning protrusion 511 (514) of the inner yoke 51, and the spacing between the other protrusion 536*a* (536*b*) and the second spacer unit 533*a* (533*b*) is set so as to correspond to the width of the positioning protrusion 512 (513) of the inner yoke 51.

Note that an integrated outer frame unit 531*a* (531*b*) is formed on the horizontal bar 530*a* (530*b*). The outer frame unit 531*a* (531*b*) is linked to an outer edge portion 542 of a first frame member 54 and an outer edge portion 552 of a second frame member 55 to be described later, and forms an overall rectangular-shaped frame unit.

Figure 31:
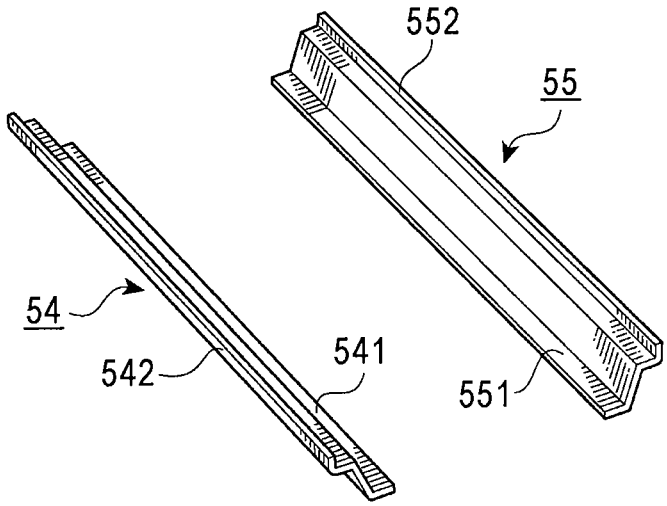
FIG. 31 is a perspective diagram illustrating a first frame member and second frame member as a pair.

The first frame member 54 and the second frame member 55 shown in FIG. 31 are formed by extrusion molding of metal or resin. The first frame member 54 and the second frame member 55 are shaped so as to stand up, spread out towards the outside from horizontal attaching units 541 and 551, and reach outer edge units 542 and 552.

Figure 32:
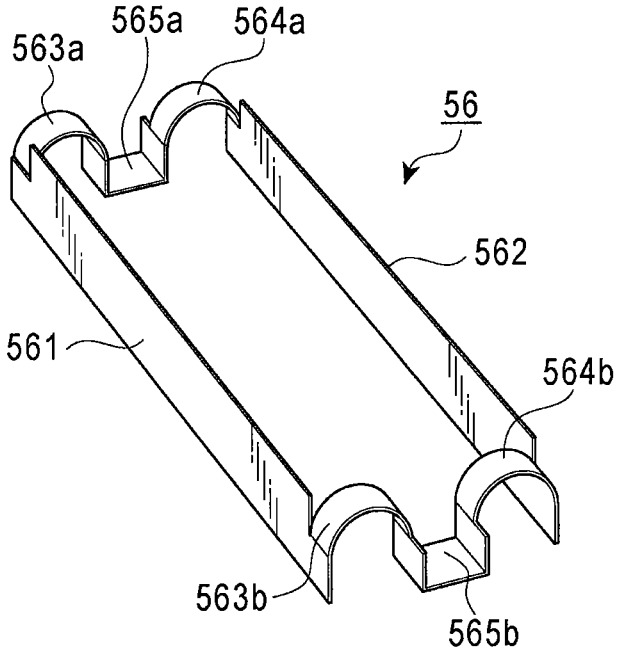
FIG. 32 is a perspective diagram illustrating a configuration of a voice coil unit.

The voice coil unit 56 shown in FIG. 32 has the same basic configuration used for the speaker device 10 according to the first embodiment (see FIG. 9), is of a configuration having a first voice coil portion 561 that is formed in a first voice coil array pattern on the surface of a flexible board, a second voice coil portion 562 that is formed in a second voice coil array pattern on the surface of the flexible board, a first-first supporting unit 563*a* that is formed following one edge portion of the first voice coil portion 561 and that is in a bent state and elastically supports the one edge portion of the first voice coil portion 561, a second-first supporting unit 563*b* that is formed following the other edge portion of the first voice coil portion 561 and that is in a bent state and elastically supports the other edge portion of the first voice coil portion 561, a first-second supporting unit 564*a* that is formed following one edge portion of the second voice coil portion 562 and that is in a bent state and elastically supports the one edge portion of the second voice coil portion 562, and a second-second supporting unit 564*b* that is formed following the other edge portion of the second voice coil portion 562 and that is in a bent state and elastically supports the other edge portion of the second voice coil portion 562. The first-first supporting unit 563*a* that elastically supports the one edge portion of the first voice coil portion 561 and the first-second supporting unit 564*a* that elastically supports the one edge portion of the second voice coil portion 562 are formed so as to be continuous, and the border portion thereof becomes a first terminal unit 565*a* having a U-shaped cross-section. Also, the second-first supporting unit 563*b* that elastically supports the other edge portion of the first voice coil portion 561 and the second-second supporting unit 564*b* that elastically supports the other edge portion of the second voice coil portion 562 are formed so as to be continuous, and the border portion thereof becomes a second terminal unit 565*b* having a U-shaped cross-section.

With the voice coil unit 56 shown in FIG. 32, the first terminal unit 565*a* and the second terminal unit 565*b* are maintained horizontally, and the first-first supporting unit 563*a* and the second-first supporting unit 563*b* that follow the one side of the first terminal unit 565*a* and the second terminal unit 565*b* are in a bent state and follow both ends of the first voice coil portion 561 of which the surface is maintained orthogonally. Also, the first-second supporting unit 564*a* and the second-second supporting unit 564*b* that follow the other side of the first terminal unit 565*a* and the second terminal unit 565*b* are in a bent state and follow both ends of the second voice coil portion 562 of which the surface is maintained orthogonally. Thus, the first voice coil portion 561 that is elastically supported with the first-first supporting unit 563*a* and the second-first supporting unit 563*b* can vibrate in the orthogonal direction, and the second voice coil portion 562 that is elastically supported with the first-second supporting unit 564*a* and the second-second supporting unit 564*b* can vibrate in the orthogonal direction.

Figure 33:
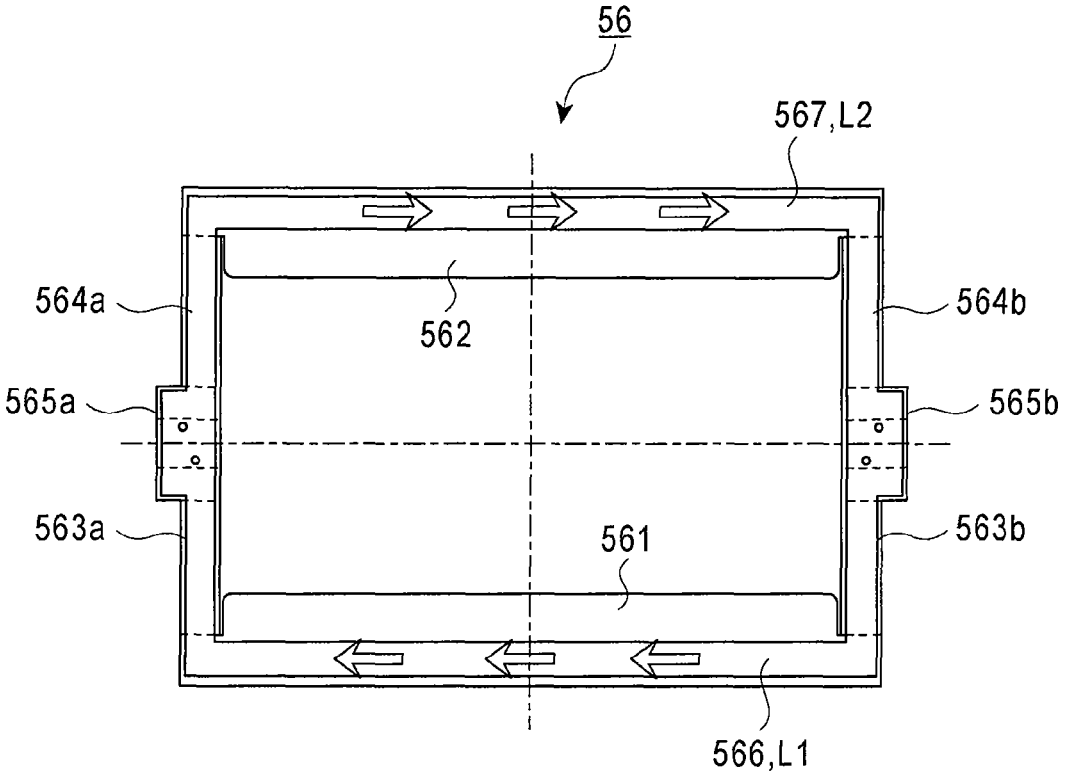
FIG. 33 is a diagram illustrating an example of a voice coil array pattern formed in the voice coil unit.

The voice coil unit 56 in a state that is laid out flat is shown in FIG. 33. In FIG. 33, a line pattern L1 is formed from the first terminal unit 565*a* through the first-first supporting unit 563*a*, the first voice coil portion 561 and the second-first supporting unit 563*b* to the second terminal unit 565*b*, as a first voice coil line pattern 566, and a line pattern L2 is formed from the second terminal unit 565*b* through the second-second supporting unit 564*b*, the second voice coil portion 562, and the first-second supporting unit 564*a*, following the line pattern L1, to return to the line pattern L1 of the first terminal unit 565*a*, as a second voice coil line pattern 567. That is to say, the line patterns L1 and L2 are formed circularly between the first terminal unit 565*a*, the first-first supporting unit 563*a*, the first voice coil portion 561, the second-first supporting unit 563*b*, the second terminal unit 565*b*, the second-second supporting unit 564*b*, the second voice coil portion 562, and the first-second supporting unit 564*a*.

For example, a pair of connecting points is formed on either the first terminal unit 565*a* or the second terminal unit 565*b*, and an audio signal is supplied to the pair of connecting points so that audio signal current flows to the first voice coil line pattern 566 (line pattern L1) formed in the first voice coil portion 561 and the second voice coil line pattern 567 (line pattern L2) formed in the second voice coil portion 562.

The speaker device 50 shown in FIG. 26 is formed by assembling the parts in the configurations described above (see FIGS. 28 through 32, FIGS. 10 through 12) as follows.

Figure 34:
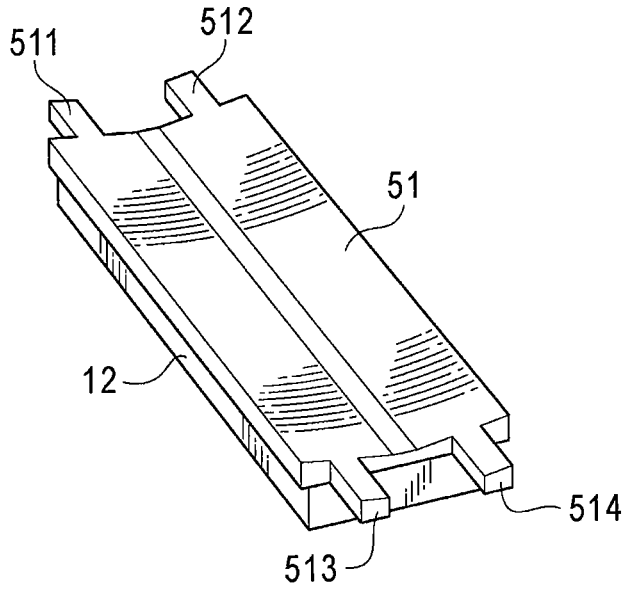
FIG. 34 is a perspective diagram illustrating a configuration unit formed by layering the inner yoke over a magnetic plate.
Figure 35:
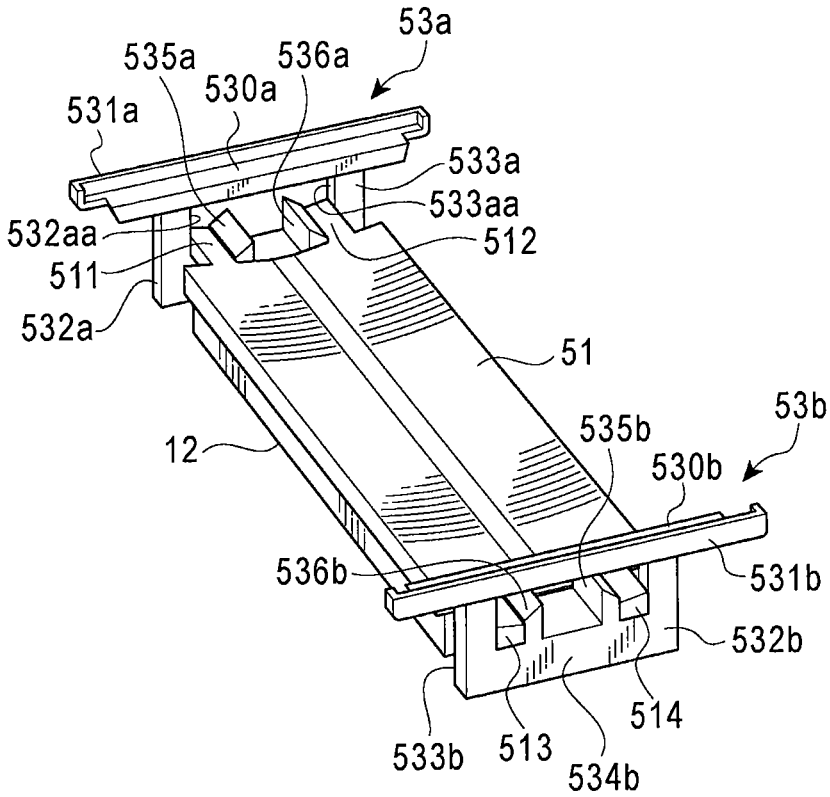
FIG. 35 is a perspective diagram illustrating a new configuration unit formed by attaching the configuration unit shown in FIG. 34 to the first positioning member and the second positioning member.

As shown in FIG. 34, the inner yoke 51 is layered over the magnetic plate 12, and next as shown in FIG. 35, the inner yoke 51 layered onto the magnetic plate 12 is subjected to position-determining by the first positioning member 53*a* and the second positioning member 56*b*. Specifically, the positioning protrusion 511 of the inner yoke 51 is subjected to positioning by the inner face 532*aa* of the first horizontal spacer unit 532*a* and the first positioning face 534*aa* of the vertical spacer unit 534*a* (see FIG. 30A), in the state of being sandwiched between the first horizontal spacer unit 532*a* and the protruding portion 535*a* of the vertical spacer unit 534*a* of the first positioning member 53*a*, and the positioning protrusion 512 of the inner yoke 51 is subjected to positioning by the inner face 533*aa* of the second horizontal spacer unit 533*a* and the second positioning face 534*ab* of the vertical spacer unit 534*a* (see FIG. 30A), in the state of being sandwiched between the second horizontal spacer unit 533*a* and the protruding portion 536*a* of the vertical spacer unit 534*a* of the first positioning member 53*a*. Also, the positioning protrusion 513 of the inner yoke 51 is subjected to positioning by the inner face 533*ba* of the second horizontal spacer unit 533*b* and the second positioning face 534*bb* of the vertical spacer unit 534*b* (see FIG. 30B), in the state of being sandwiched between the second horizontal spacer unit 533*b* and the protruding portion 536*b* of the vertical spacer unit 534*b* of the second positioning member 53*b*, and the positioning protrusion 514 of the inner yoke 51 is subjected to positioning by the inner face 532*ba* of the first horizontal spacer unit 532*b* and the first positioning face 534*ba* of the vertical spacer unit 534*b* (see FIG. 30B), in the state of being sandwiched between the first horizontal spacer unit 532*b* and the protruding portion 535*b* of the vertical spacer unit 534*b* of the second positioning member 53*b*.

Thus, the inner yoke 51 that is layered over the magnetic plate 12 is subjected to positioning in the horizontal direction by the first positioning member 53*a* and the second positioning member 53*b*.

Figure 36:
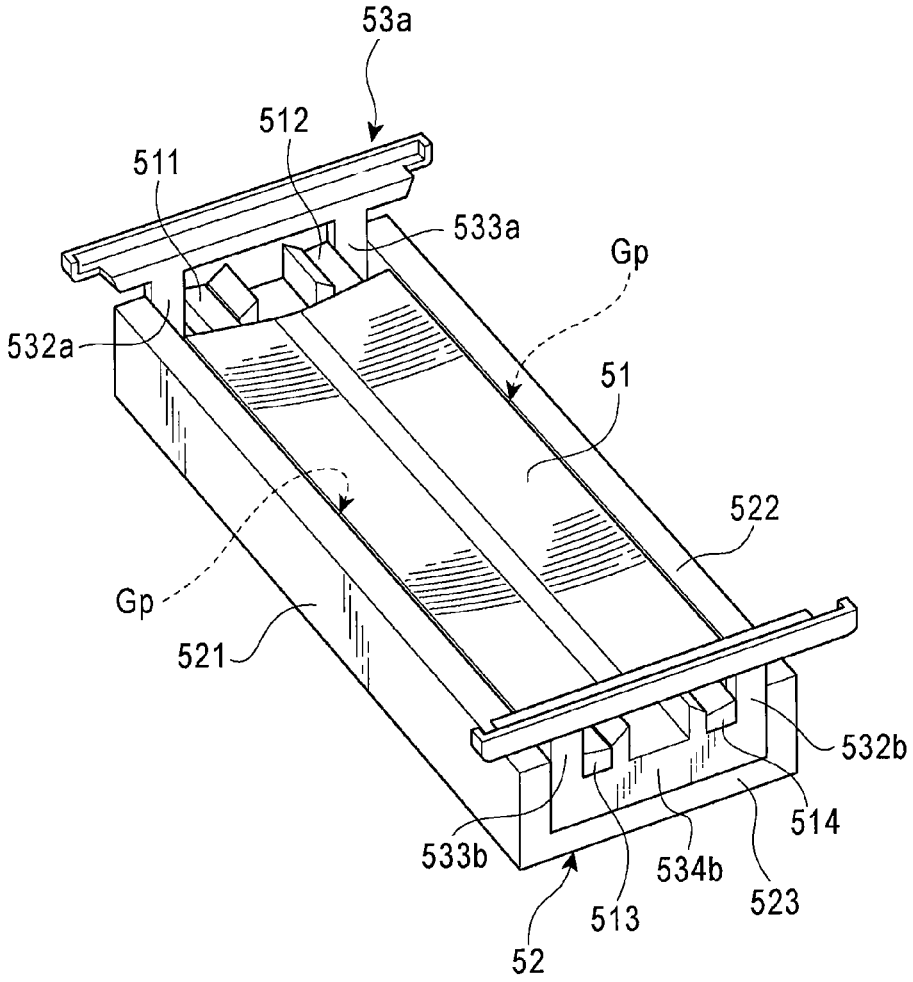
FIG. 36 is a perspective diagram illustrating a new configuration unit in a state wherein the outer yoke is set in the first positioning member and the second positioning member of the configuration unit shown in FIG. 35.

In this state, as shown in FIG. 36, the outer yoke 52 having a U-shaped cross-section is fit onto the first positioning member 53*a* and the second positioning member 53*b*. The outer face of the first horizontal spacer unit 532*a* of the first positioning member 53*a* abuts against the inner face of the first outer yoke unit 521 of the outer yoke 52, the outer face of the second horizontal spacer unit 533*a* of the first positioning member 53*a* abuts against the inner face of the second outer yoke unit 522 of the outer yoke 52, and the outer face of the vertical spacer unit 534*a* of the first positioning member 53*a* abuts against the inner face of the linking unit 523 of the outer yoke 52, while the outer face of the first horizontal spacer 532*b* of the second positioning member 53*b* abuts against the inner face of the second outer yoke 522, the outer face of the second horizontal spacer unit 533*b* of the second positioning member 53*b* abuts against the inner face of the first outer yoke unit 521 of the outer yoke 52, and the outer face of the vertical spacer unit 534*b* of the second positioning unit 53*b* abuts against the inner face of the linking unit 523 of the outer yoke 52.

Thus, the magnetic plate 12 is sandwiched between the inner yoke 51 and the linking unit 532 of the outer yoke 52, and the spacing thereof is maintained at a thickness of the vertical spacers 534*a* and 534*b* (corresponding to the thickness of the magnetic plate 12). Also, the space between each of the positioning protrusions 511 and 513 of the inner yoke 51 and the plate face of the first outer yoke portion 521 is held at a spacing equivalent to the width of the first horizontal spacer unit 532*a* of the first positioning member 53*a* and the second horizontal spacer unit 533*b* of the second positioning member 53*b*, and the space between each of the positioning protrusions 512 and 514 of the inner yoke 51 and the plate face of the second outer yoke portion 522 is held at a spacing equivalent to the width of the second horizontal spacer unit 533*a* of the first positioning member 53*a* and the first horizontal spacer unit 532*b* of the second positioning member 53*b*. Consequently, as shown in the details of FIG. 27 as well as FIG. 36, a magnetic gap Gp is formed between the plate face of the first outer yoke portion 521 and one of the side end faces of the inner yoke 51, and a magnetic gap Gp is formed between the plate face of the second outer yoke portion 522 and the other side end face of the inner yoke 51.

Figure 27:
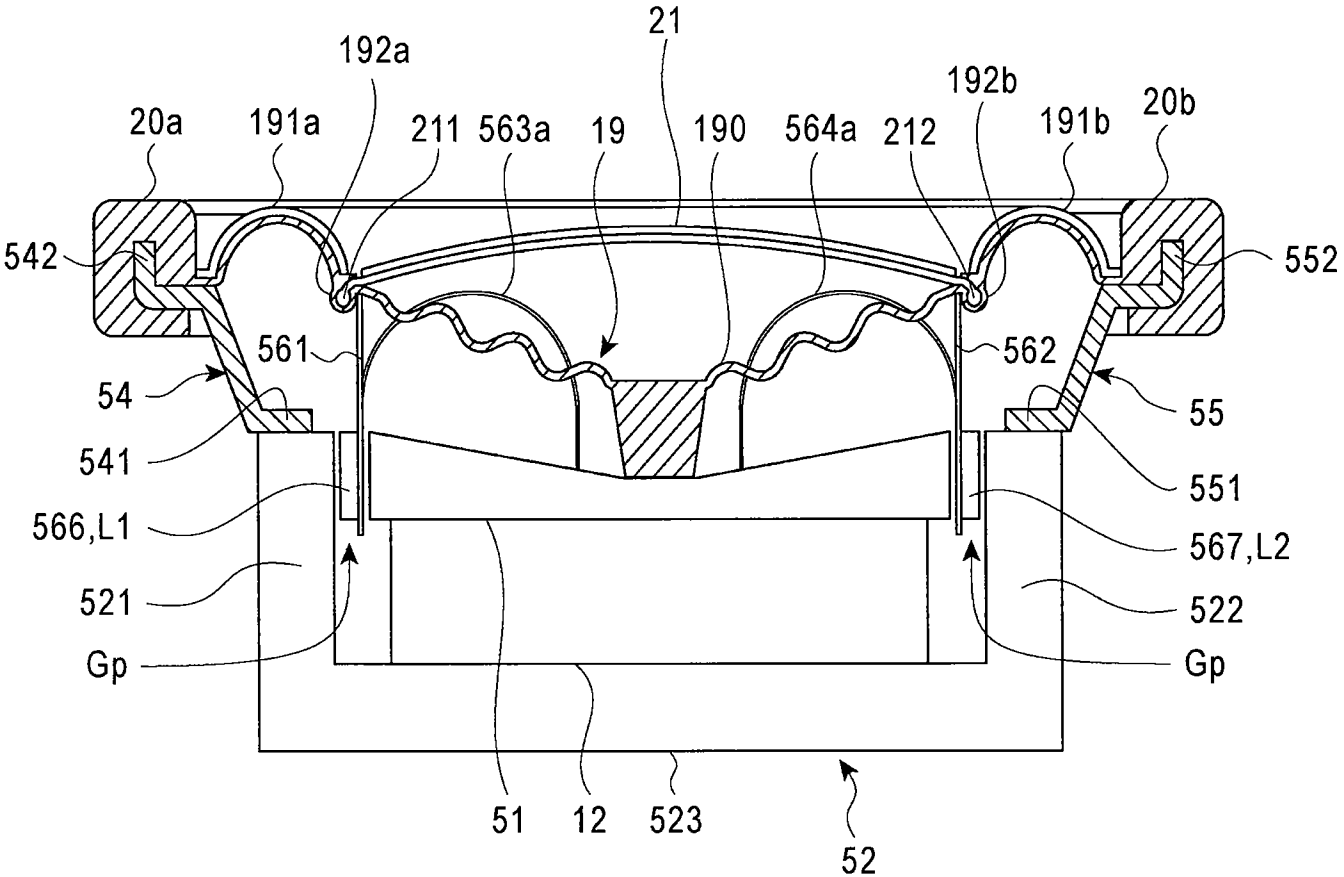
FIG. 27 is a cross-sectional diagram showing a cross-sectional configuration of the speaker device shown in FIG. 26 cut away at line XXVII-XXVII.
Figure 37:
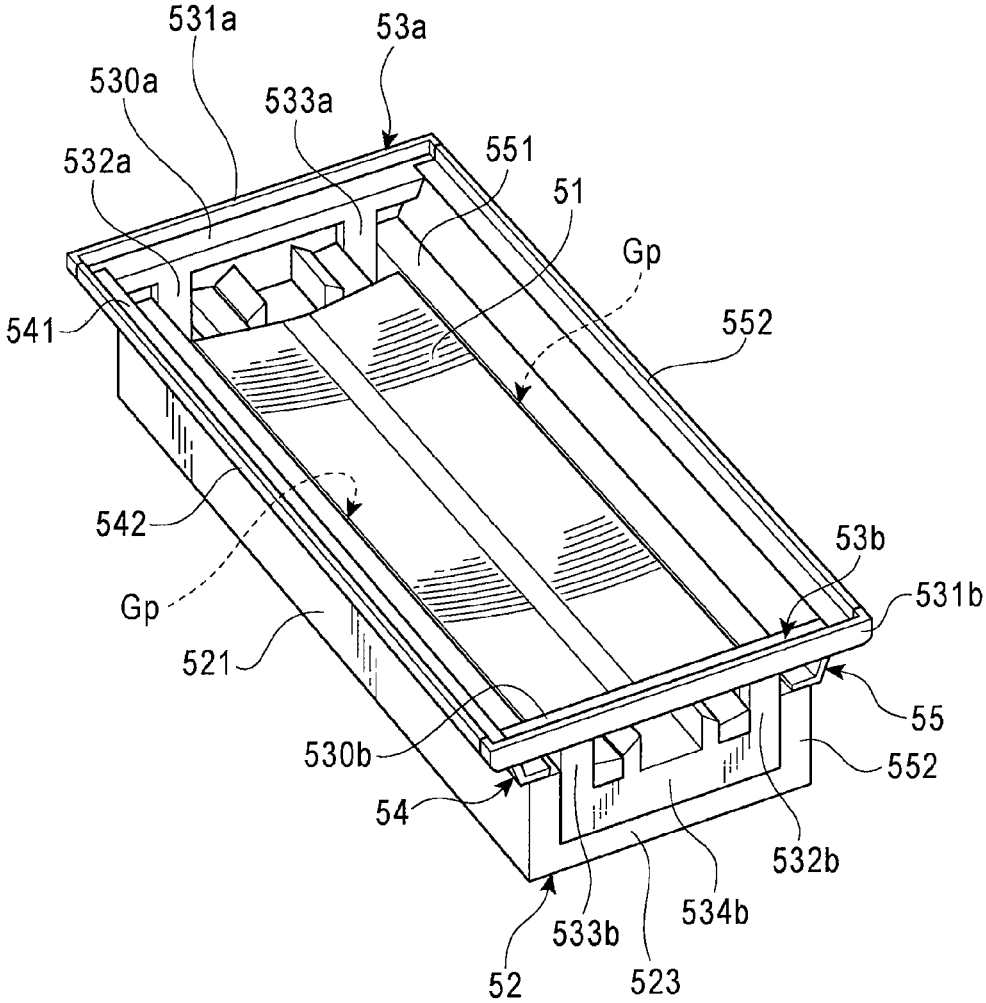
FIG. 37 is a perspective diagram illustrating a new configuration unit formed by fixed a first frame member and a second frame member to the configuration unit shown in FIG. 36.

Next, as shown in FIG. 27 as well as FIG. 37, the first frame member 54 is fixed on the upper edge end face of the first outer yoke portion 521 of the outer yoke 52 which is in a state of sandwiching the magnetic plate 12 with the inner yoke 51 and the linking unit 523, and the second frame member 55 is fixed on the upper edge end face of the second outer yoke portion 522 of the outer yoke 52. Specifically, an attaching unit 541 of the first frame member 54 is fixed on the upper edge end face of the first outer yoke portion 521 with an adhesive, and an attaching unit 551 of the second frame member 55 is adhered so as to be fixed to the upper edge end face of the second outer yoke portion 522. Both ends of the outer edge portion 542 of the first frame member 54 engage with one end of the outer frame unit 531*a* of the first positioning member 53*a* and one end of the outer frame unit 531*b* of the second positioning member 53*b*, and both ends of the outer edge portion 552 of the second frame member 55 engage with the other end of the outer frame unit 531*a* of the first positioning member 53*a* and the other end of the outer frame unit 531*b* of the second positioning member 53*b*. Thus, the magnetic circuit made up of the inner yoke 51 and the outer yoke 52 is surrounded by a frame unit made up of the outer edge portion 542 of the first frame member 54, the outer edge portion 552 of the second frame member 55, the outer frame unit 531*a* of the first positioning member 53*a*, and the outer frame unit 531*b* of the second positioning member 53*b*.

Figure 38:
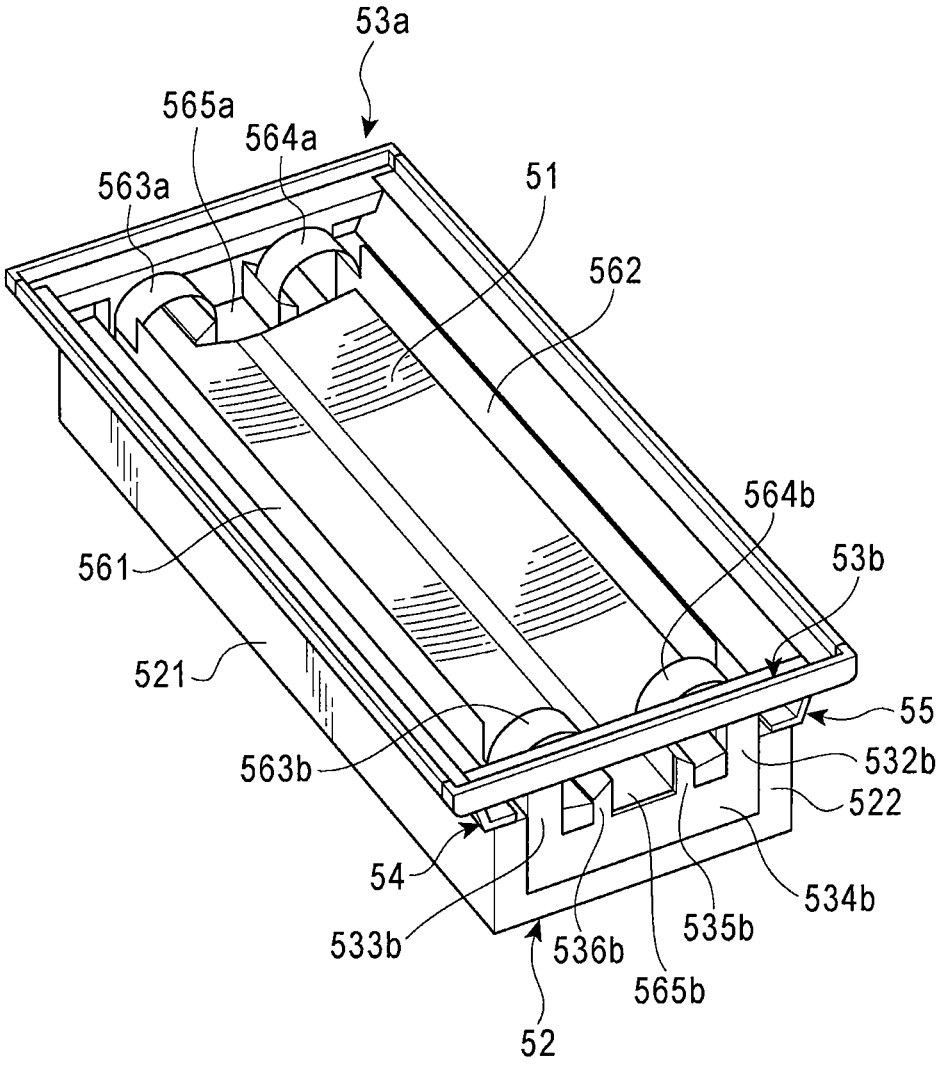
FIG. 38 is a perspective diagram illustrating a new configuration unit formed by attaching the voice coil unit to the configuration unit shown in FIG. 37.

Next, as shown in FIG. 38, the voice coil unit 56 (see FIG. 32) is set with respect to the above-described magnetic circuit. Specifically, the first voice coil portion 561 of the voice coil unit 56 is disposed within the magnetic gap Gp that is formed between one side end face of the inner yoke 51 and the plate face of the first outer yoke portion 521, and the second voice coil portion 562 is disposed within the magnetic gap Gp that is formed between the other side end face of the inner yoke 51 and the plate face of the second outer yoke portion 522 (see FIG. 27). The first terminal unit 565*a* is fixed to a terminal set face 537*a* between the two protruding portions 535*a* and 536*a* of the vertical spacer unit 534*a* of the first positioning member 53*a* (see FIG. 30A), and the second terminal unit 565*b* is fixed to a terminal set face 537*b* between the two protruding portions 535*b* and 536*b* of the vertical spacer unit 534*b* of the second positioning member 53*b* (see FIG. 30B). In this state, the first voice coil portion 561 that is disposed within the magnetic gap Gp formed between the one side end face of the inner yoke 51 and the plate face of the first outer yoke portion 521 has both end portions elastically supported by the first-first supporting unit 563*a* following the first terminal unit 565*a* and the second-first supporting unit 563*b* following from the second terminal unit 565*b*, and can vibrate vertically within the magnetic gap Gp. Also, the second voice coil portion 562 that is disposed within the magnetic gap Gp formed between the other side end face of the inner yoke 51 and the plate face of the second outer yoke portion 522 has both end portions elastically supported by the first-second supporting unit 564*a* following the first terminal unit 565*a* and the second-second supporting unit 564*b* following from the second terminal unit 565*b*, and can vibrate vertically within the magnetic gap Gp. Also, as shown in FIG. 27, the line pattern L1 of the first voice coil line pattern 566 formed in the first voice coil portion 561 is arrayed between one of the side end faces of the inner yoke 51 and the plate face of the first outer yoke portion 521 (magnetic gap Gp), and the line pattern L2 of the second voice coil line pattern 567 formed in the second voice coil portion 562 is arrayed between the other side end face of the inner yoke 51 and the plate face of the second outer yoke portion 522 (magnetic gap Gp).

Figure 39:
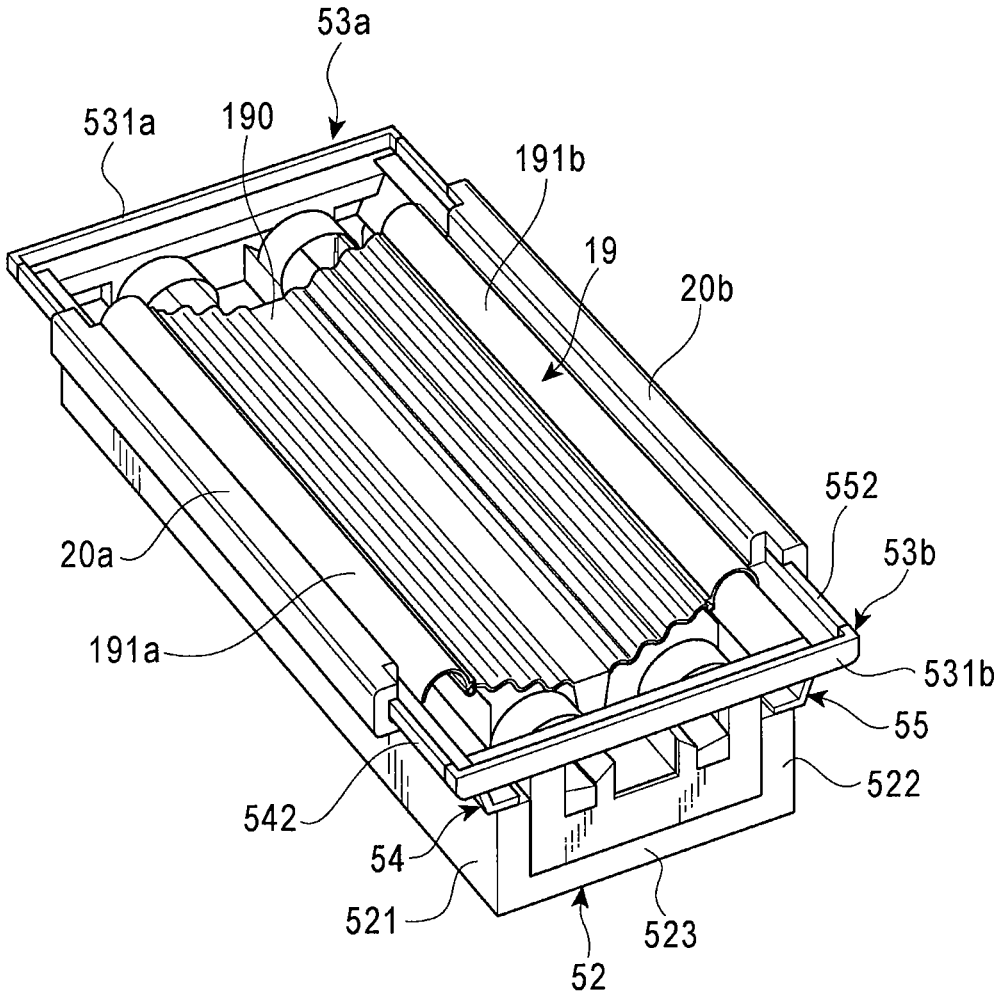
FIG. 39 is a perspective diagram illustrating a new configuration unit formed by attaching a damper member to the configuration unit shown in FIG. 38.

Next, as shown in FIG. 39, the damper member 19 is attached. Similar to the case of the speaker device 10 according to the first embodiment of the present invention, the damper member 19 is provided between the outer edge portion 542 of the first frame member 54 and the outer edge portion 552 of the second frame member 55, so as to cover the magnetic circuit and the voice coil unit 56 described above. Fixing the damper member 19 to the first frame member 54 and the second frame member 55 is performed by sliding to fit the first fitting groove 20*aa* of the first vertical edge unit 20*a* onto the outer edge portion 542 of the first frame member 54, and similarly sliding to fit the second fitting groove 20*ba* of the second vertical edge unit 20*b* onto the outer edge portion 552 of the second frame member 55 (see FIG. 21.)

Also, the leading end portion of the first voice coil portion 561 is fixed to the border portion of the damper main unit 190 and first supporting unit 191*a* (the portion forming the first fitting groove 192*a*) with an adhesive, and the leading end portion of the second voice coil portion 562 is fixed to the border portion of the damper main unit 190 and the second supporting unit 191*b* (the portion forming the second fitting groove 192*b*) with an adhesive. Thus, the entire voice coil unit 56 is elastically supported by the damper member 19.

Figure 40:
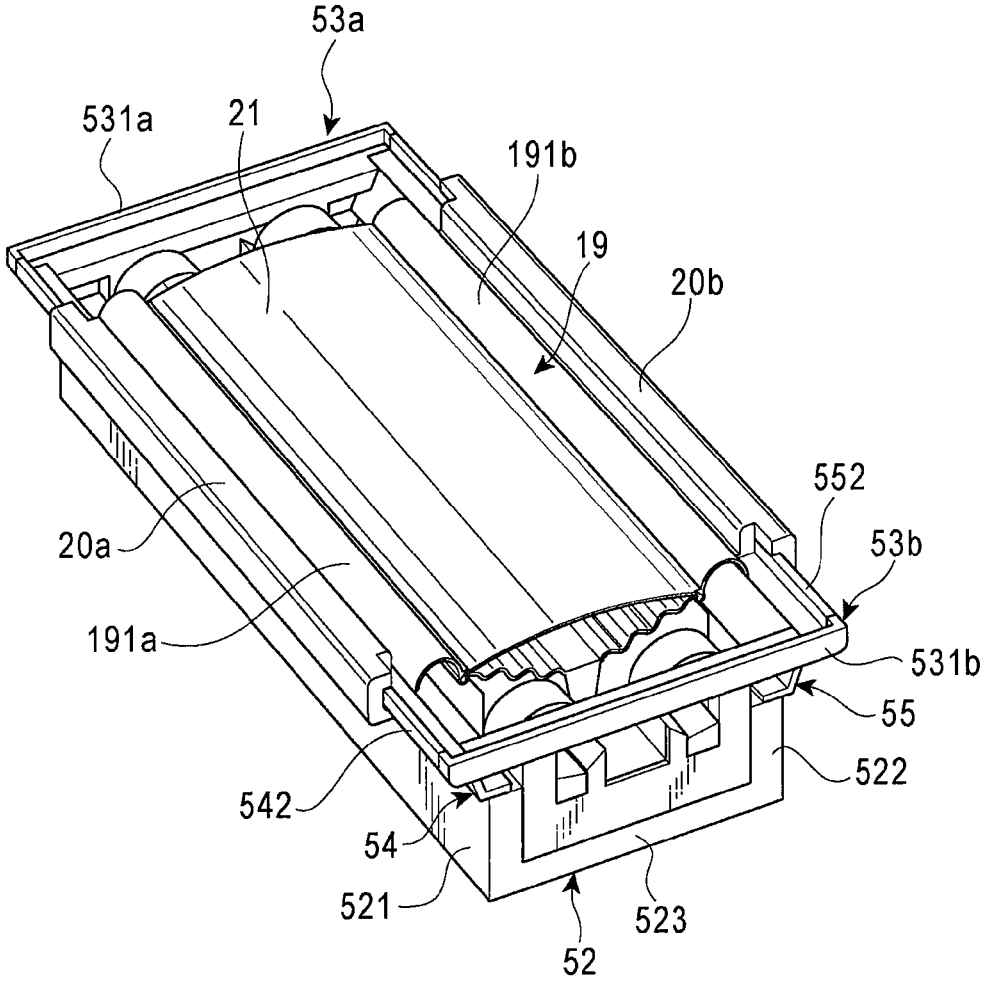
FIG. 40 is a perspective diagram illustrating a new configuration unit formed by attaching a diaphragm to the configuration unit shown in FIG. 39.

Next, as shown in FIG. 40, the damper member 19 is attached to the diaphragm 21. Also similar to the case of the speaker device 10 according to the first embodiment of the present invention, a first sliding unit 211 of the diaphragm 21 is slid to fit into the first fitting groove 192*a* formed in the border portion between the damper main unit 190 and the first supporting unit 191*a*, and also, a second sliding unit 212 of the diaphragm 21 is similarly slid to fit into the second fitting groove 192*b* formed in the border portion between the damper main unit 190 and the second supporting unit 191*b* (see FIGS. 21 and 23). As shown in FIG. 26, the first horizontal edge portion 22*a* and the second horizontal edge portion 22*b* are attached, and the assembly of the various parts is ended. Attaching the first horizontal edge portion 22*a* and the second horizontal edge portion 22*b* is also performed similar to the case of the speaker device 10 according to the first embodiment of the present invention.

When the various parts are thus assembled, the magnetic plate 12 is magnetized. When the magnetic plate 12 is magnetized, the inner yoke 51 and the outer yoke 52 are drawn to the magnetic plate 12, and these are strongly integrated along with the first positioning member 53*a* and the second positioning member 53*b*. However, it should be noted that the magnetic gap Gp between one of the side end faces of the inner yoke 51 and the plate face of the first outer yoke portion 521, and the magnetic gap Gp between the other side end face of the inner yoke 51 and the plate face of the second outer yoke portion 522 are accurately maintained by the first positioning member 53*a* and the second positioning member 53*b*.

Note that the parts that are assembled as described above may be adhesively fixed with an adhesive agent as needed before the magnetic plate 12 is magnetized.

The electrical connection with the audio signal output circuit of the voice coil unit 56 is performed with a coupler terminal that is fit into the first terminal unit 565*a* and the second terminal unit 565*b* of the voice coil unit 56, similar to the case of the speaker device 10 according to the first embodiment of the present invention (see FIGS. 24A and 24B).

Figure 41:
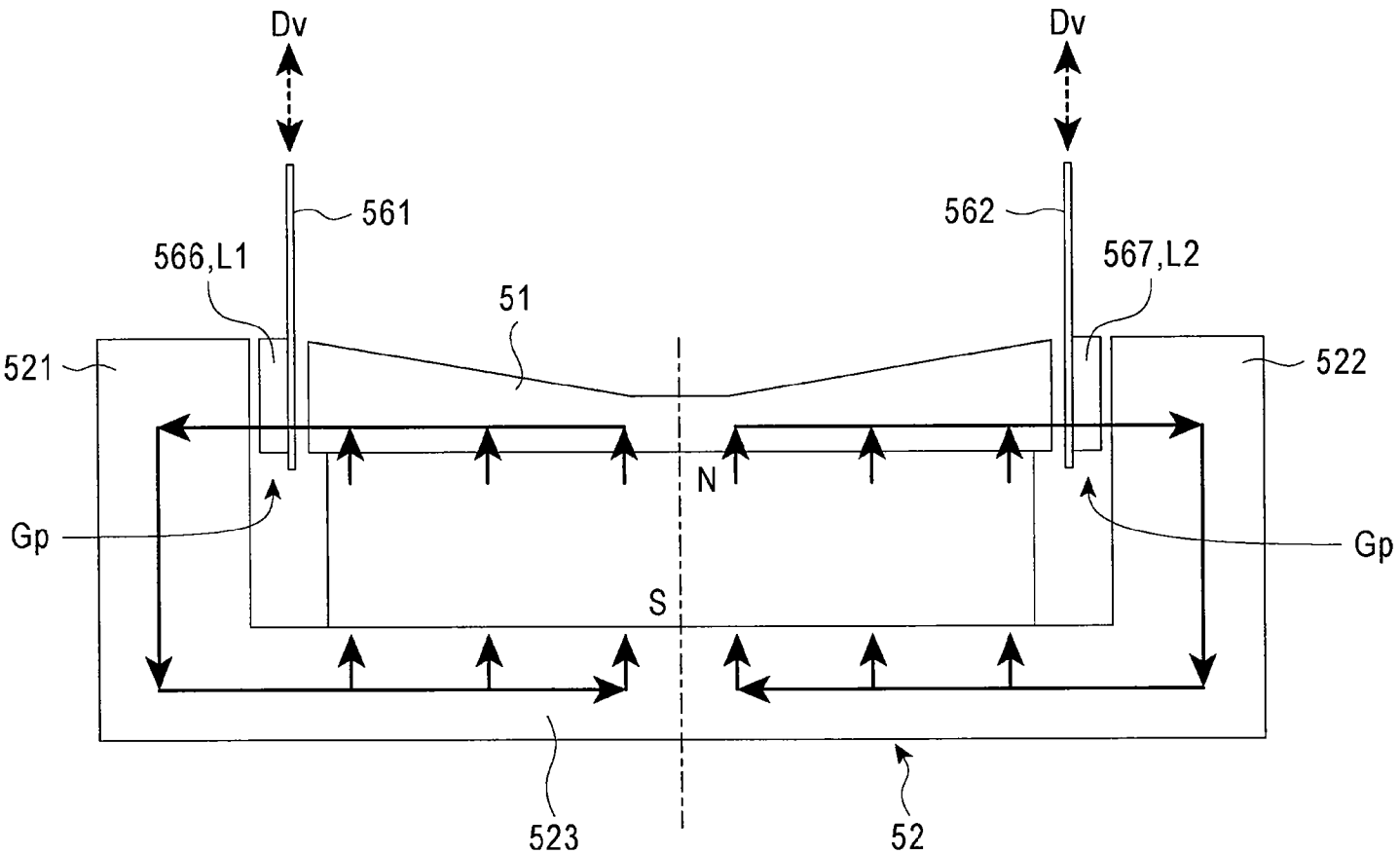
FIG. 41 is a diagram illustrating a magnetic flux within a magnetic circuit in the speaker device of a configuration shown in FIG. 27.

As shown in FIG. 41, a magnetic flux is generated in the magnetic circuit (magnetic plate 12, inner yoke 51, and outer yoke 52). In FIG. 41, the magnetic flux from the North pole side of the magnetic plate 12 travels from one side end face of the inner yoke 51, cuts across the magnetic gap Gp, arrives at the first outer yoke portion 521 of the outer yoke 52, and from the first outer yoke portion 521 further passes through the linking unit 523 and returns to the South pole face of the magnetic plate 12. Also, the magnetic flux from the North pole side of the magnetic plate 12 travels from the other side end face of the inner yoke 51, cuts across the magnetic gap Gp, arrives at the second outer yoke portion 522 of the outer yoke 52, and from the second outer yoke portion 522 further passes through the linking unit 523 and returns to the South pole face of the magnetic plate 12.

An audio signal is supplied to the first voice coil line pattern 566 (L1) and the second voice coil line pattern 567 (L2) of the voice coil unit 56 in the state that the magnetic flux is formed in the magnetic circuit, as shown in FIG. 41. In FIG. 41, the magnetic flux that cuts across the magnetic gap Gp formed between one of the side end faces of the inner yoke 51 and the plate face of the first outer yoke portion 521, and the magnetic flux that cuts across the magnetic gap Gp formed between the other side end face of the inner yoke 51 and the plate face of the second outer yoke portion 522, go in the opposite directions, but the direction of the audio current flowing between the first voice coil line pattern 566 (L1) and the second voice coil line pattern 567 (L2) arrayed within each magnetic gap Gp also goes in opposite directions, whereby force acts in the same direction as, the line pattern L11 and the line pattern L12 by mutual action of the magnetic flux within the magnetic gap Gp and the audio signal current, and the first voice coil portion 561 formed in the first voice coil line pattern 566 (L1) and the second voice coil portion 562 formed in the second voice coil line pattern 567 vibrate in the vertical direction Dv according to the audio signal.

With the vibrations in the vertical direction of the first voice coil portion 561 and the second voice coil portion 562 according to the audio signal, the diaphragm 21 which is linked to the voice coil portions 561 and 562 vibrates according to the audio signal. Consequently, sound corresponding to the audio signal is output.

With a speaker device 50 according to the second embodiment as described above, the magnetic circuit is in a state wherein the positions of the inner yoke 51 and the outer yoke 52 are determined by the first positioning member 53*a* and the second positioning member 53*b* so that the magnetic gap Gp is formed, whereby the magnetic plate 12, the inner yoke 51, and the outer yoke 52 have an integrated configuration, and so the magnetic circuit can be assembled in a workable manner by the first positioning member 53*a* and the second positioning member 53*b*. Further, other parts, specifically the voice coil unit 56, and the first horizontal edge unit 22*a* and the second horizontal edge unit 22*b* are also attached to the first positioning member 53*a* and the second positioning member 53*b*, whereby the assembly workability is further improved.

Also, the positions of the inner yoke 51 and the outer yoke 52 are determined by the first positioning member 53*a* and the second positioning member 53*b*, whereby even if the position fixing force by adhesive agent of the inner yoke 51 and the outer yoke 52 is reduced, position shifting can be prevented. As a result, disassembly of the magnetic circuit (magnetic plate 12, inner yoke 51 and outer yoke 52) becomes easy, whereby recycling individual parts of the magnetic circuit becomes relatively easy.

As described above, the speaker device according to the present invention is advantageous in that the construction is such that the magnetic circuit can be assembled with good workability and recycling of individual parts is relatively easy, and is useful as a speaker device that outputs sound by causing vibration of a diaphragm which is connected to a voice coil by mutual action between a magnetic field generated in a magnetic circuit and an audio signal current that flows through the voice coil.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker device comprising:

a magnet; an outer yoke; an inner yoke forming a magnetic circuit with said magnet and said outer yoke so as to form a magnetic gap between said outer yoke and said inner yoke, such that a magnetic flux generated from said magnet cuts across the gap; a diaphragm; a voice coil unit linked to said diaphragm, disposed within said magnetic gap; and at least one positioning member assembled with said inner yoke and said outer yoke to determine the positions with respect to one another of said inner yoke and said outer yoke, which link magnetically to said magnet; wherein said at least one positioning member comprises a spacer unit, an inner surface of said spacer unit contacting said inner yoke and an outer surface of said spacer unit contacting said outer yoke to define said magnetic gap; wherein said voice coil unit further comprising: a voice coil portion formed on the surface of a flexible material in a voice coil array pattern; and a supporting unit that is formed following said voice coil portion of said flexible material, and elastically supports the voice coil portion; wherein said supporting unit is fixed to said positioning member so that said voice coil portion is disposed within said magnetic gap.

2. The speaker device according to claim 1, said at least one positioning member further comprising:

an inner yoke positioning unit to determine the position of said inner yoke.

3. The speaker device according to claim 1, further comprising:

a frame member to contain said positioning member, said inner yoke and said outer yoke that are subjected to positioning with the at least one positioning member, and the voice coil unit to which the supporting unit that elastically supports said voice coil portion on said positioning member is fixed.

4. A speaker device comprising:

a magnet;

an outer yoke;

an inner yoke forming a magnetic circuit with said magnet and said outer yoke so as to form a magnetic gap between said outer yoke and said inner yoke, such that a magnetic flux generated from said magnet cuts across the gap;

a diaphragm;

a voice coil unit linked to said diaphragm, disposed within said magnetic gap;

a rectangular plate-shaped first outer yoke and second outer yoke;

a rectangular plate-shaped first inner yoke and second inner yoke; and positioning members assembled with said inner yoke and said outer yoke to determine the positions with respect to one another of said first inner yoke and said second inner yoke that sandwich said magnet, and said first outer yoke and said second outer yoke, to define a magnetic gap between a plate face of said first outer yoke and one side end face of each of said first inner yoke and said second inner yoke, and between a plate face of said second outer yoke and the other side end face of each of said first inner yoke and said second inner yoke;

wherein said positioning members comprise a first spacer unit to hold the spacing between said first outer yoke and each of said first inner yoke and said second inner yoke to be the spacing of said magnetic gap, an inner surface of said first spacer unit contacting each of said first inner yoke and said second inner yoke and an outer surface of said first spacer unit contacting said first outer yoke, and a second spacer unit to hold the spacing between said second outer yoke and each of said first inner yoke and said second inner yoke to be the spacing of said magnetic gap, an inner surface of said second spacer unit contacting each of said first inner yoke and said second inner yoke and an outer surface of said second spacer unit contacting said second outer yoke.

5. The speaker device according to claim 4, said positioning members further comprising:

an inner yoke positioning portion to determine the positions of said first inner yoke and said second inner yoke in the state of sandwiching said magnet.

6. The speaker device according to claim 4, said voice coil unit further comprising:

a first voice coil portion formed on the surface of a flexible material in a first voice coil array pattern;

a second voice coil portion formed on the surface of a flexible material in a second voice coil array pattern;

a first supporting unit that is formed following said first voice coil portion on said flexible material and that elastically supports the first voice coil portion;

a second supporting unit that is formed following said second voice coil portion on said flexible material and that elastically supports the second voice coil portion;

wherein said first supporting unit is fixed to said positioning member so that said first voice coil portion is disposed in the magnetic gap formed between said first outer yoke and each of said first inner yoke and said second inner yoke;

and wherein said second supporting unit is fixed to said positioning member so that said second voice coil portion is disposed in the magnetic gap formed between said second outer yoke and each of said first inner yoke and said second inner yoke.

7. The speaker device according to claim 4, further comprising:

a first positioning member serving as said positioning member to determine the position of one end portion of each of said first inner yoke and said second inner yoke having sandwiched said magnet, and one end portion of each of said first outer yoke and said second outer yoke; and a second positioning member to determine the position of the other end portion of said first inner yoke and said second inner yoke, and the other end portion of said first outer yoke and said second outer yoke.

8. The speaker device according to claim 7, said voice coil unit further comprising:

a first voice coil portion formed on the surface of a flexible material in a first voice coil array pattern;

a second voice coil portion formed on the surface of a flexible material in a second voice coil array pattern;

a first-first supporting unit and a second-first supporting unit that are formed following both end portions of said first voice coil portion on said flexible material and that elastically supports said first voice coil portion;

a first-second supporting unit and a second-second supporting unit that are formed following both end portions of said second voice coil portion on said flexible material and that elastically supports said second voice coil portion;

wherein said first-first supporting unit and said second-first supporting unit are fixed to said first positioning member and said second positioning member so that said first voice coil portion is disposed in the magnetic gap formed between said first outer yoke and each of said first inner yoke and said second inner yoke;

and wherein said first-second supporting unit and said second-second supporting unit are fixed to said first positioning member and said second positioning member so that said second voice coil portion is disposed in the magnetic gap formed between said second outer yoke and each of said first inner yoke and said second inner yoke.

9. The speaker device according to claim 8, wherein said first-first supporting unit that elastically supports one end portion of said first voice coil unit and said first-second supporting unit that elastically supports one end portion of said second voice coil portion are formed so as to be continuous, and the border portion between said first-first supporting unit and said first-second supporting unit is fixed to said first positioning member;

and wherein said second-first supporting unit that elastically supports the other end portion of said first voice coil unit and said second-second supporting unit that elastically supports the other end portion of said second voice coil portion are formed so as to be continuous, and the border portion between said second-first supporting unit and said second-second supporting unit is fixed to said second positioning member.

10. The speaker device according to claim 8, further comprising:

a frame member that contains said first positioning member and said second positioning member;

said first inner yoke and said second inner yoke that are subjected to positioning by said first positioning member and said second positioning member and that sandwich said magnet;

said first outer yoke and said second outer yoke that are subjected to positioning by said first positioning member and said second positioning member; and a voice coil unit wherein said first-first supporting unit, said second-first supporting unit, said first-second supporting unit, and said second-second supporting unit which elastically support said first voice coil portion and said second voice coil portion are fixed to said first positioning member and said second positioning member.

11. The speaker device according to claim 10, said speaker device further comprising:

a damper member;

wherein said damper member is formed between an edge portion fixed to a first outer edge portion of said frame member that extends between said first positioning member and said second positioning member along a magnetic gap that is formed between said first outer yoke and each of said first inner yoke and said second inner yoke, and an edge portion fixed to a second outer edge portion of said frame member that extends between said first positioning member and said second positioning member along a magnetic gap that is formed between said second outer yoke and each of said first inner yoke and said second inner yoke;

and wherein said first voice coil portion and one end portion of said diaphragm are fixed to predetermined positions on said first outer edge portion side of said frame member of said damper member;

and wherein said second voice coil portion and the other end portion of said diaphragm are fixed to predetermined positions on said second outer edge portion side of said frame member of said damper member.

12. The speaker device according to claim 11, wherein both said edge portions are fixed by sliding to mate with said first outer edge portion and said second outer edge portion of said frame member.

13. The speaker device according to claim 11, wherein one end portion of said diaphragm is fixed to said predetermined portion of said first outer edge portion side of said frame member of said damper member by sliding to mate;

and wherein the other end portion of said diaphragm is fixed to said predetermined portion of said second outer edge portion side of said frame member of said damper member by sliding to mate.

14. A speaker device comprising:

a magnet;

an outer yoke;

an inner yoke forming a magnetic circuit with said magnet and said outer yoke so as to form a magnetic gap between said outer yoke and said inner yoke, such that a magnetic flux from said magnet cuts across the gap;

a diaphragm;

a voice coil unit linked to said diaphragm, disposed within said magnetic gap;

a linking unit, formed on said outer yoke, to link an end portion of a first outer yoke portion and a second outer yoke portion that are disposed so as to face one another, said outer yoke being formed to have a generally U shaped cross-section; and positioning members assembled with said inner yoke and said outer yoke to determine the positions with respect to one another of said inner yoke and said outer yoke which sandwiches said magnet with the inner yoke by said linking unit, to define a magnetic gap between one side end face of said inner yoke and said first outer yoke portion, and between the other side end face of said inner yoke and said second outer yoke portion;

wherein said positioning members comprise a spacer unit, inner surfaces of said spacer unit contacting side end faces of said inner yoke and outer surfaces of said spacer unit contacting said first outer yoke portion and said second outer yoke portion to define the spacing of said magnetic gap.

15. The speaker device according to claim 14, said positioning members having an inner yoke positioning-determining unit to determine the position of said inner yoke.

16. The speaker device according to claim 14, said voice coil unit further comprising:

a first voice coil portion formed on the surface of a flexible material in a first voice coil array pattern;

a second voice coil portion formed on the surface of a flexible material in a second voice coil array pattern;

a first supporting unit that is formed following said first voice coil portion on said flexible material and that elastically supports the first voice coil portion;

a second supporting unit that is formed following said second voice coil portion on said flexible material and that elastically supports the first voice coil portion;

wherein said first supporting unit is fixed to said positioning member so that said first voice coil portion is disposed in the magnetic gap formed between said inner yoke and said first outer yoke portion of said outer yoke;

and wherein said second supporting unit is fixed to said positioning member so that said second voice coil portion is disposed in the magnetic gap formed between said inner yoke and said second outer yoke portion of said outer yoke.

17. The speaker device according to claim 14, comprising:

a first positioning member serving as said positioning member that engages with one end portion of said inner yoke and one end portion of said outer yoke so that a magnetic gap is formed between said inner yoke and each of said first outer yoke portion and said second outer yoke portion of said outer yoke; and a second positioning member serving as said positioning member that engages with the other end portion of said inner yoke and the other end portion of said outer yoke so that a magnetic gap is formed between said inner yoke and each of said first outer yoke portion and said second outer yoke portion of said outer yoke.

18. The speaker device according to claim 17, said voice coil unit further comprising:

a first voice coil portion formed on the surface of a flexible material in a first voice coil array pattern;

a second voice coil portion formed on the surface of a flexible material in a second voice coil array pattern;

a first-first supporting unit and second-first supporting unit that are formed following both end portions of said first voice coil portion on said flexible material and that elastically supports said first voice coil portion;

a first-second supporting unit and second-second supporting unit that are formed following both end portions of said second voice coil portion on said flexible material and that elastically supports said second voice coil portion;

wherein said first-first supporting unit and said second-first supporting unit are fixed to said first positioning member and said second positioning member so that said first voice coil portion is disposed in the magnetic gap formed between said inner yoke and said first outer yoke portion of said outer yoke;

and wherein said first-second supporting unit and second-second supporting unit are fixed to said first positioning member and said second positioning member so that said second voice coil portion is disposed in the magnetic gap formed between said inner yoke and said second outer yoke portion of said outer yoke.

19. The speaker device according to claim 18, wherein said first-first supporting unit that elastically supports one end portion of said first voice coil unit and said first-second supporting unit that elastically supports one end portion of said second voice coil portion are formed so as to be continuous, and the border portion between said first-first supporting unit and said first-second supporting unit is fixed to said first positioning member;

and wherein said second-first supporting unit that elastically supports the other end portion of said first voice coil unit and said second-second supporting unit that elastically supports the other end portion of said second voice coil portion are formed so as to be continuous, and the border portion between said second-first supporting unit and said second-second supporting unit is fixed to said second positioning member.

20. The speaker device according to claim 19, comprising:

a first frame member fixed to an end portion on the opposite side from the end portion to which said linking unit of said first outer yoke portion of said outer yoke connects;

a second frame member fixed to an end portion on the opposite side from the end portion to which said linking unit of said second outer yoke portion of said outer yoke connects; and a damper member formed between an edge portion fixed to said first frame member and an edge portion fixed to said second frame member;

wherein said first voice coil portion and one end portion of said diaphragm is fixed to a predetermined position on said first frame member side of said damper member;

and wherein said second voice coil portion and the other end portion of said diaphragm is fixed to a predetermined position on said second frame member side of said damper member.

21. The speaker device according to claim 20, wherein said both edge portions are fixed by sliding to fit said first frame member and said second frame member.

22. The speaker device according to claim 20, wherein one end portion of said diaphragm is fixed by sliding to fit in said predetermined position on said first frame member side of said damper member, and wherein the other end portion said diaphragm is fixed by sliding to fit in said predetermined position on said second frame member side of said damper member.

* * * * *